US006300053B1

(12) United States Patent
Fujiwara et al.

(10) Patent No.: US 6,300,053 B1
(45) Date of Patent: Oct. 9, 2001

(54) PHOTOTHERMOGRAPHIC ELEMENT

(75) Inventors: Itsuo Fujiwara; Ichizo Toya; Masaki Noro, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/283,576

(22) Filed: Apr. 1, 1999

(30) Foreign Application Priority Data

Apr. 7, 1998 (JP) ..... 10-095082

(51) Int. Cl.[7] ..... G03C 1/498; G03C 1/815

(52) U.S. Cl. ..... 430/619; 430/510; 430/513; 430/517; 430/603; 430/955

(58) Field of Search ..... 430/603, 619, 430/513, 517, 510, 955

(56) References Cited

U.S. PATENT DOCUMENTS 4,548,896 * 10/1985 Sabongi et al. ..... 430/332
4,729,942 * 3/1988 Takahashi et al. ..... 430/351
5,135,842 8/1992 Kitchin et al. .
5,258,274 * 11/1993 Helland et al. ..... 430/522
5,314,795 5/1994 Helland et al. .
5,324,627 6/1994 Stevenson et al. .
5,384,237 1/1995 Stevenson et al. .
5,817,598 * 10/1998 Defieuw et al. ..... 503/201

* cited by examiner

*Primary Examiner*—Thorl Chea
(74) *Attorney, Agent, or Firm*—Birch, Stewart, Kolasch & Birch, LLP

(57) ABSTRACT

A photothermographic element has on a support a photosensitive layer, and a first non-photosensitive layer containing (1) a base-bleachable dye or a salt thereof and (2) a binder. The first non-photosensitive layer or a second non-photosensitive layer disposed adjacent thereto contains (3) a base precursor and (4) a melting point depressant. The dye (1) becomes more bleachable and the processed image becomes more water resistant.

16 Claims, 1 Drawing Sheet

PHOTOTHERMOGRAPHIC ELEMENT

This invention relates to a photothermographic element and more particularly, to a photothermographic element which is improved in dye decolorization and produces water-resistant images.

BACKGROUND OF THE INVENTION

Photothermographic elements are known from the past and described, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969. The photothermographic elements generally have photosensitive layers which contain a reducible silver salt (e.g., organic silver salt), a catalytic amount of a photocatalyst (e.g., silver halide), a reducing agent, and optionally a toner for controlling the tone of silver, typically dispersed in an binder matrix. After imagewise exposure, photothermographic elements are heated at an elevated temperature (e.g., 80° C. or higher), whereby redox reaction takes place between the reducible silver salt (functioning as an oxidizing agent) and the reducing agent to form a black silver image. This redox reaction is promoted by the catalysis of a latent image of silver halide produced by exposure. The black silver image is thus formed in the exposed area.

Thermography or heat development has the advantage of easy and quick processing because it eliminates a need for processing solution as used in the wet development process. However, the image forming process by wet development is still the mainstream in the photographic art. This is because the thermographic process yet leaves an outstanding problem which never occurs with the wet development process.

It is a common practice to add dyes to photographic photosensitive materials as a filter or for the anti-halation or anti-irradiation purpose. Specifically, the dye is added to a non-photosensitive layer and exerts its function upon imagewise exposure. If the dye having exerted its function is left in the photographic photosensitive material, the image formed therein can be colored with that dye. Therefore, the dye must be removed from the photographic photosensitive material during development. In the wet development process, the dye can be readily removed from the photographic photosensitive material into the processing solution. By contrast, the thermographic process is very difficult or substantially impossible to remove the dye.

A simple and quick development process is required for the modern photographic art, especially in the fields of medical photography and printing photography. Improvements in the wet development process, however, have approached the plateau. For this reason and others, engineers in the fields of medical photography and printing photography now pay attention to the thermographic image formation.

With respect to the problem of difficult removal of dyes in the thermographic process, it was proposed to decolorize the dye by the heat applied during heat development. For example, U.S. Pat. No. 5,135,842 discloses that polymethine dyes of a specific structure can be decolorized by heating. U.S. Pat. Nos. 5,314,795, 5,324,627, and 5,384,237 disclose that polymethine dyes are heated for decolorization using carbanion generators.

Some of the prior art methods, however, are short in decolorization, failing to reach a sufficient degree of transparency within the desired time. Some dyes are quickly bleachable, but a problem is left with respect to the water resistance of processed images. When the processed elements are incidentally contacted with water droplets or stored in high-humidity conditions, a loss of transparency occurs, resulting in alterations.

SUMMARY OF THE INVENTION

Therefore, an object of the invention is to provide a photothermographic element having an increased rate of decolorization of a dye by the heat applied during heat development and the improved water resistance of a coating.

According to a first aspect of the invention, there is provided a photothermographic element comprising a support having a first surface and a second surface, at least one photosensitive layer on the first surface of the support, and a first non-photosensitive layer on the first or second surface of the support. The first non-photosensitive layer contains (1) a base-bleachable dye or a salt thereof and (2) a binder. The first non-photosensitive layer or a second non-photosensitive layer disposed adjacent thereto contains (3) a base precursor and (4) a melting point depressant which, when mixed with the base precursor, acts to depress the melting point by at least 3° C., or a mixture of melting point depressants which, when mixed with the base precursor, cooperate to depress the melting point by at least 3° C.

Preferably, a co-dispersion of the base precursor (3) and the melting point depressant or the melting point depressant mixture (4) is contained in the non-photo-sensitive layer. Typically the photosensitive layer contains a photosensitive silver halide, an organic silver salt, a reducing agent, and a binder. The first and second non-photosensitive layers are preferably disposed on the second surface of the support.

According to a second aspect of the invention, there is provided a photothermographic element comprising a support having a first surface and a second surface, at least one photosensitive layer on the first surface of the support, and a non-photosensitive layer on the first or second surface of the support. The non-photosensitive layer contains a compound of the following formula (I):

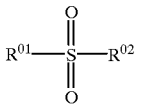

(I)

wherein $R^{01}$ and $R^{02}$ independently represent an aliphatic, aromatic or heterocyclic group which is free of a carboxyl group and carboxyl group salt.

Typically, the photosensitive layer contains a photosensitive silver halide, an organic silver salt, a reducing agent, and a binder. Preferably, the non-photosensitive layer or another non-photosensitive layer disposed adjacent thereto contains a base-bleachable dye or a salt thereof and a base precursor. Preferably, a co-dispersion of the base precursor and the compound of formula (I) is contained in the non-photosensitive layer. The non-photosensitive layer is preferably disposed on the second surface of the support.

In the photothermographic elements of the first and second aspects, the base-bleachable dye or salt thereof is preferably a cyanine dye or salt thereof having the following formula (II):

(II)

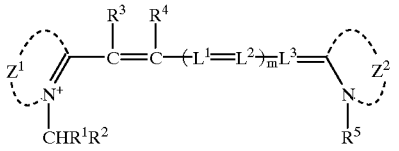

wherein $R^1$ represents an electron attractive group; $R^2$ represents hydrogen or an aliphatic or aromatic group; $R^3$ and $R^4$ independently represent hydrogen, a halogen atom, an aliphatic group, an aromatic group, —$NR^6R^7$, —$OR^6$, or —$SR^7$; $R^6$ and $R^7$ independently represent hydrogen or an aliphatic or aromatic group; $R^5$ represents an aliphatic group; each of $L^1$, $L^2$, and $L^3$ independently represents a substituted or unsubstituted methine group in which substituents on the methine group may bond together to form an unsaturated aliphatic ring or an unsaturated heterocyclic ring; each of $Z^1$ and $Z^2$ independently represents a group of atoms that form a 5- or 6-membered nitrogenous heterocyclic ring which may have an aromatic ring fused thereto, and the nitrogenous heterocyclic ring or the ring fused thereto may have a substituent; and m represents 0, 1, 2 or 3.

Also preferably, the base precursor is a diacidic base precursor.

DESCRIPTION OF THE PREFERRED EMBODIMENTS

Figure 1:
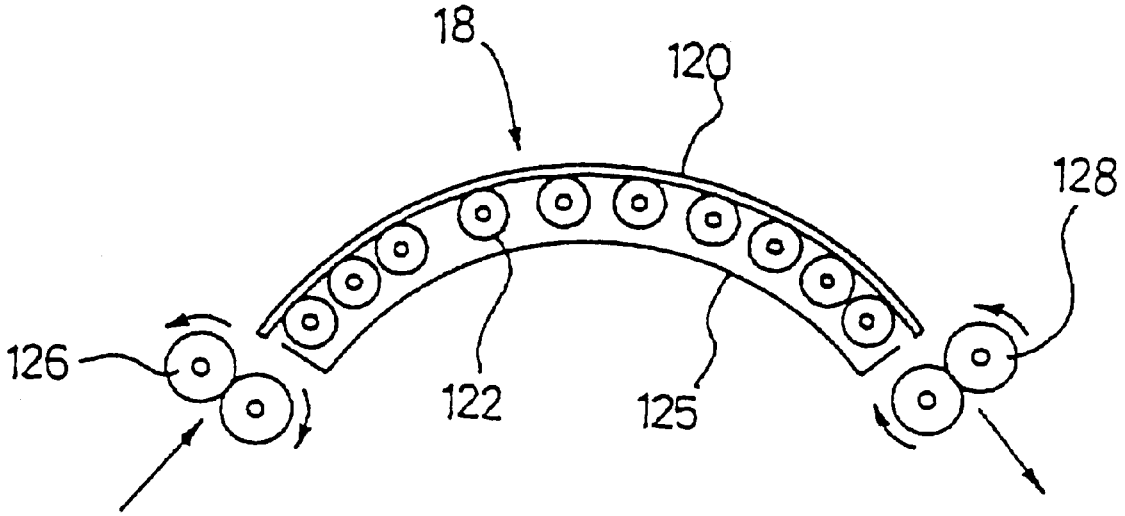
FIGS. 1 and 2 schematically illustrate typical plate heater development systems.

In the photothermographic element according to one embodiment of the invention, a first non-photosensitive layer containing (1) a base-bleachable dye or a salt thereof and (2) a binder or a second non-photosensitive layer disposed adjacent thereto contains (3) a base precursor and (4) a melting point depressant.

Melting Point Depressant

The melting point depressant used herein is a substance which when mixed with the base precursor, acts to depress the melting point of the base precursor by at least 3° C.

The melting point depressant is such that the melting point of a mixture of the base precursor and the melting point depressant is lower than the melting point of the base precursor alone by at least 3° C., preferably by about 3 to 20° C., more preferably by about 5 to 15° C. Such a change of melting point can be observed by mixing two powders of the base precursor and the melting point depressant in a mortar and analyzing the mixture by differential scanning calorimetry (DSC). It is acceptable to use two or more melting point depressants at the same time. The melting point depressant may be either a single compound which can depress the melting point by at least 3 degrees when used alone or a mixture of two or more compounds which can cooperate to depress the melting point by at least 3 degrees when used in combination.

The melting point depressant is preferably added as a co-dispersion of the melting point depressant and the base precursor, and especially a solid particle co-dispersion of the mixture. The dispersed particles preferably have a mean particle size of 0.03 to 0.3 $\mu$m.

Any of the melting point depressants that satisfy the above requirement may be used. Of these, those melting point depressants having a melting point equal to or higher than the melting point of the base precursor are preferable. Specifically, melting point depressants having a melting point of 50 to 200° C., especially 70 to 150° C. are advantageously used. Also, the melting point depressants stable to bases are preferable. The base precursor and the melting point depressant may be used in any desired mixing ratio.

The melting point depressants that satisfy the above requirement are, for example, those compounds commonly employed as thermal solvents. Examples include waxes such as paraffin wax, microcrystalline wax, fatty acid amide wax, stearic acid amide, and ethylene bisstearoamide; amides such as benzamide, N-methylbenzamide, fatty acid amides, and acetoacetic acid anilide; sulfonamides such as p-toluene-sulfonamide and N-methylbenzenesulfonamide; carboxylic acid esters such as phenyl benzoate, dimethyl terephthalate, and diphenyl phthalate; arylnitriles; phenol derivatives such as 2,6-di-tert-butyl-4-methylphenol and 2,2'-dihydroxy-4,4'-dimethoxybenzophenone; naphthol derivatives such as benzyl-1-naphthyl ether and phenoxyacetic acid-2-naphthyl ester; alcohols such as sorbitol; urea derivatives such as N-methylurea, N-phenylurea, and N,N-dimethyl-N'-phenylurea; urethanes such as phenylcarbamoyloxydecane and p-tolyl-carbamoyloxybenzene; substituted biphenyls such as 4-(2-phenylethoxy)biphenyl, biphenyl phenyl methane, and 4-acetyloxybiphenyl; ethers such as 1,2-diphenoxyethane and 1,4-bis(p-tolyloxy)butane; thioethers such as 1,2-bis(p-methoxyphenylthio)ethane; aromatic hydrocarbons such as bibenzyl, biphenyl, and triphenylmethane; benzotriazole derivatives such as 2-(2'-hydroxy-5'-methylphenyl)-benzotriazole; and sulfones such as diphenylsulfone, bis(4-chlorophenyl)sulfone, 4-chlorophenyl(phenyl)sulfone, 4-(phenylsulfonyl) phenylsulfonylmethane, and methanesulfonylbenzene.

Of these, amides, phenol derivatives, naphthol derivatives, benzotriazole derivatives, and sulfones are more preferable. Most preferred are sulfones of the formula (I): $R^{01}$—$SO_2$—$R^{02}$ wherein $R^{01}$ and $R^{02}$ independently represent an aliphatic, aromatic or heterocyclic group free of a carboxyl group and carboxyl group salt.

The term "aliphatic" is used herein as encompassing alkyl, substituted alkyl, alkenyl, substituted alkenyl, alkynyl, substituted alkynyl, aralkyl and substituted aralkyl groups. Of these, alkyl, substituted alkyl, alkenyl, substituted alkenyl, aralkyl and substituted aralkyl groups are preferred herein, with the alkyl, substituted alkyl, aralkyl and substituted aralkyl being more preferred. The chain aliphatic groups may be branched.

Preferably, the alkyl groups have 1 to 30 carbon atoms, more preferably 1 to 20 carbon atoms, most preferably 1 to 15 carbon atoms. The alkyl moieties of the substituted alkyl groups are the same as the above-described alkyl groups. The alkenyl and alkynyl groups preferably have 2 to 30 carbon atoms, more preferably 2 to 20 carbon atoms, most preferably 2 to 15 carbon atoms. The alkenyl and alkynyl moieties of the substituted alkenyl and alkynyl groups are the same as the above-described alkenyl and alkynyl groups, respectively.

The term "aromatic" is used herein as encompassing aryl and substituted aryl groups. Preferably, the aryl groups have 6 to 30 carbon atoms, more preferably 6 to 20 carbon atoms, most preferably 6 to 15 carbon atoms. The aryl moieties of the substituted aryl groups are the same as the above-described aryl groups.

The term "heterocyclic" is used herein as encompassing substituted or unsubstituted 5- or 6-membered heterocyclic groups. The heterocyclic moieties of the substituted heterocyclic groups are the same as the heterocyclic groups described below. Exemplary heterocycles of the heterocyclic groups include pyrrole, indole, furan, thiophene, imidazole, pyrazole, indolizine, quinoline, carbazole, phenothiazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin, and chroman. These rings may have substituents.

The substituents that the above-described groups may have are not limitative although carboxyl groups and salts of carboxyl groups are excluded. Illustrative substituents include sulfonamide groups of 1 to 20 carbons atoms, such as methanesulfonamide, benzenesulfonamide, butanesulfonamide, and n-octanesulfonamide; sulfamoyl groups of 0 to 20 carbon atoms, such as unsubstituted sulfamoyl, methylsulfamoyl, phenylsulfamoyl, and butylsulfamoyl; sulfonylcarbamoyl groups of 2 to 20 carbon atoms, such as methanesulfonylcarbamoyl, propanesulfonylcarbamoyl, and benzenesulfonylcarbamoyl; acylsulfamoyl groups of 1 to 20 carbon atoms, such as acetylsulfamoyl, propionylsulfamoyl, and benzoylsulfamoyl; chain or cyclic alkyl groups of 1 to 20 carbon atoms, such as methyl, ethyl, cyclohexyl, 2-hydroxyethyl, 4-carboxybutyl, 2-methoxyethyl, benzyl, 4-carboxybenzyl, and 2-diethylaminoethyl; alkenyl groups of 2 to 20 carbon atoms, such as vinyl and allyl; alkoxy groups of 1 to 20 carbon atoms, such as methoxy, ethoxy, and butoxy; halogen atoms such as F, Cl, and Br; amino groups of 0 to 20 carbon atoms, such as unsubstituted amino, dimethylamino, diethylamino, and carboxyethylamino; alkoxycarbonyl groups of 2 to 20 carbon atoms, such as methoxycarbonyl; amide groups of 1 to 20 carbon atoms, such as acetamide and benzamide; carbamoyl groups of 1 to 20 carbon atoms, such as unsubstituted carbamoyl, methylcarbamoyl, and phenylcarbamoyl; aryl groups of 6 to 20 carbon atoms, such as phenyl, naphthyl, 4-carboxyphenyl, 4-methanesulfonamidophenyl, and 3-benzoylaminophenyl; aryloxy groups of 6 to 20 carbon atoms, such as phenoxy, 3-methylphenoxy, and naphthoxy; alkylthio groups of 1 to 20 carbon atoms, such as methylthio and octylthio; arylthio groups of 6 to 20 carbon atoms, such as phenylthio and naphthylthio; acyl groups of 1 to 20 carbon atoms, such as acetyl, benzoyl, and 4-chlorobenzoyl; sulfonyl groups of 1 to 20 carbon atoms, such as methanesulfonyl and benzenesulfonyl; ureido groups of 1 to 20 carbon atoms, such as methylureido and phenylureido; alkoxycarbonylamino groups of 2 to 20 carbon atoms, such as methoxycarbonylamino and hexyloxycarbonylamino; cyano groups; hydroxyl groups; nitro groups; and heterocyclic groups such as 5-ethoxycarbonylbenzoxazole, pyridine, sulforan, furan, pyrrole, pyrrolidine, morpholine, piperazine, and pyrimidine rings.

$R^{01}$ preferably represents an aromatic group. For substituted aryl groups, preferred substituents are substituted or unsubstituted alkyl groups, substituted or unsubstituted aryl groups, substituted or unsubstituted aralkyl groups, acyl groups, sulfonyl groups, alkoxycarbonyl groups, alkoxy groups, substituted or unsubstituted carbamoyl groups, and halogen atoms. More preferred are substituted or unsubstituted alkyl, substituted or unsubstituted aryl, sulfonyl, alkoxy, and halogen. Most preferred are a substituted or unsubstituted alkyl group, a sulfonyl group, and a halogen atom.

$R^{02}$ preferably represents an aliphatic or aromatic group. When $R^{02}$ represents an aliphatic group, a substituted or unsubstituted alkyl group and a substituted or unsubstituted aralkyl group are preferred, with the alkyl group and aralkyl group being more preferred.

When $R^{02}$ represents an aromatic group, preferred substituents on a substituted aryl group are a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, and a halogen atom. More preferred are a substituted or unsubstituted alkyl group, a substituted or unsubstituted aryl group, a sulfonyl group, an alkoxy group, and a halogen atom. Most preferred are a substituted or unsubstituted alkyl group, a sulfonyl group, and a halogen atom.

An appropriate amount of the melting point depressant used is 1 to 500% by weight, preferably 5 to 200% by weight of the base precursor.

Illustrative, non-limiting, examples of the compound of formula (I) are given below.

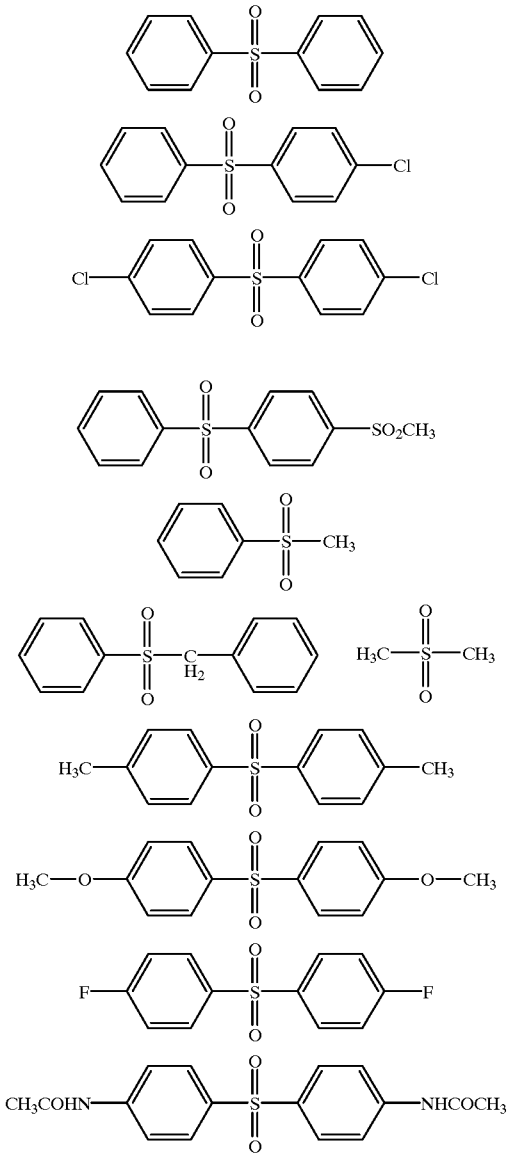

-continued

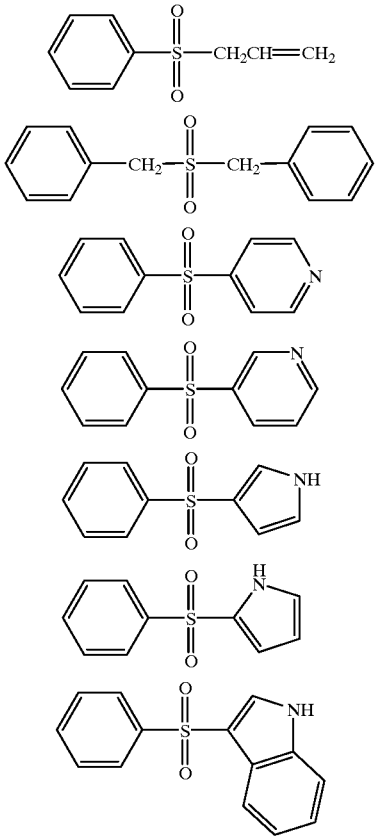

Base-bleachable Dye

The base-bleachable dye is a dye which can be bleached with the base. A salt of the base-bleachable dye is also useful. The dye or salt used herein is preferably a cyanine dye of the following formula (II) or a salt thereof.

(II)

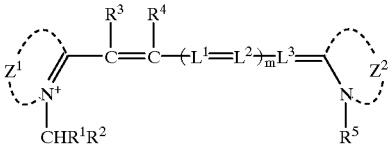

In formula (II), $R^1$ represents an electron attractive group; $R^2$ represents hydrogen or an aliphatic or aromatic group; $R^3$ and $R^4$ independently represent hydrogen, a halogen atom, an aliphatic group, an aromatic group, —$NR^6R^7$, —$OR^6$ or —$SR^7$; $R^6$ and $R^7$ independently represent hydrogen or an aliphatic or aromatic group; $R^5$ represents an aliphatic group; each of $L^1$, $L^2$, and $L^3$ independently represents a substituted or unsubstituted methine group in which substituents on the methine group may bond together to form an unsaturated aliphatic ring or an unsaturated heterocyclic ring; each of $Z^1$ and $Z^2$ independently represents a group of atoms that form a 5- or 6-membered nitrogenous heterocyclic ring which may have an aromatic ring fused thereto, wherein the nitrogenous heterocyclic ring or the ring fused thereto may be substituted; and m represents 0, 1, 2 or 3.

Formula (II) is described in more detail. $R^1$ represents an electron attractive group, preferably having a degree of electron withdrawal such that the Hammett substituent constant $\sigma_m$ (as defined in Chem. Rev., 91, 165 (1991), for example) may range from 0.3 to 1.5. More preferred of these are substituents represented by —C(=O)$R^{11}$ and —$SO_pR^{12}$ and cyano groups. Herein, $R^{11}$ represents hydrogen, an aliphatic group, an aromatic group, —$OR^{13}$, —$SR^{13}$ or —$NR^{13}R^{14}$; $R^{12}$ represents an aliphatic group, an aromatic group, —$OR^{13}$, or —$NR^{13}R^{14}$; and p represents 1 or 2. $R^{13}$ and $R^{14}$ independently represent hydrogen, an aliphatic or aromatic group, or $R^{13}$ and $R^{14}$, taken together, form a nitrogenous heterocyclic ring. More preferably, $R^1$ represents —C(=O)$R^{11}$, especially those wherein $R^{11}$ represents —$OR^{13}$ or —$NR^{13}R^{14}$. It is most preferred for the shelf stability of the photothermographic element that $R^1$ represents —C(=O)$R^{11}$ wherein $R^{11}$ represents —$NR^{13}R^{14}$.

The term "aliphatic" is used herein as encompassing alkyl, substituted alkyl, alkenyl, substituted alkenyl, alkynyl, substituted alkynyl, aralkyl and substituted aralkyl groups. Of these, alkyl, substituted alkyl, alkenyl, substituted alkenyl, aralkyl and substituted aralkyl groups are preferred herein, with the alkyl, substituted alkyl, aralkyl and substituted aralkyl being more preferred. Chain aliphatic groups are preferable to cyclic aliphatic groups. The chain aliphatic groups may be branched.

Preferably, the alkyl groups have 1 to 30 carbon atoms, more preferably 1 to 20 carbon atoms, most preferably 1 to 15 carbon atoms. The alkyl moieties of the substituted alkyl groups are the same as the above-described alkyl groups. The alkenyl and alkynyl groups preferably have 2 to 30 carbon atoms, more preferably 2 to 20 carbon atoms, most preferably 2 to 15 carbon atoms. The alkenyl and alkynyl moieties of the substituted alkenyl and alkynyl groups are the same as the above-described alkenyl and alkynyl groups, respectively.

The term "aromatic" is used herein as encompassing aryl and substituted aryl groups. Preferably, the aryl groups have 6 to 30 carbon atoms, more preferably 6 to 20 carbon atoms, most preferably 6 to 15 carbon atoms. The aryl moieties of the substituted aryl groups are the same as the above-described aryl groups.

The substituents that the above-described groups may have are not limitative. Illustrative substituents include carboxyl groups which may form a salt; sulfo groups which may form a salt; sulfonamide groups of 1 to 20 carbons atoms, such as methanesulfonamide, benzenesulfonamide, butanesulfonamide, and n-octanesulfonamide; sulfamoyl groups of 0 to 20 carbon atoms, such as unsubstituted sulfamoyl, methylsulfamoyl, phenylsulfamoyl, and butylsulfamoyl; sulfonylcarbamoyl groups of 2 to 20 carbon atoms, such as methanesulfonylcarbamoyl, propanesulfonylcarbamoyl, and benzenesulfonylcarbamoyl; acylsulfamoyl groups of 1 to 20 carbon atoms, such as acetylsulfamoyl, propionylsulfamoyl, and benzoylsulfamoyl; chain or cyclic alkyl groups of 1 to 20 carbon atoms, such as methyl, ethyl, cyclohexyl, trifluoromethyl, 2-hydroxyethyl, 4-carboxybutyl, 2-methoxyethyl, 2-ethoxyethyl, benzyl, 4-carboxybenzyl, and 2-diethylaminoethyl; alkenyl groups of 2 to 20 carbon atoms, such as vinyl and allyl; alkoxy groups of 1 to 20 carbon atoms, such as methoxy, ethoxy, and butoxy; halogen atoms such as F, Cl, and Br; amino groups of 0 to 20 carbon atoms, such as unsubstituted amino, dimethylamino, diethylamino, and carboxyethylamino; alkoxycarbonyl groups of 2 to 20 carbon atoms, such as methoxycarbonyl; amide groups of 1 to 20 carbon atoms, such as acetamide, benzamide and 4-chlorobenzamide; carbamoyl groups of 1 to 20 carbon atoms, such as unsubstituted carbamoyl, methylcarbamoyl, phenylcarbamoyl, and benzimidazol-2-onecarbamoyl; aryl groups of 6 to 20 carbon atoms, such as phenyl, naphthyl, 4-carboxyphenyl, 4-methanesulfonamidophenyl, and 3-benzoylaminophenyl; aryloxy groups of 6 to 20 carbon atoms, such as phenoxy, 3-methylphenoxy, and naphthoxy; alkylthio groups of 1 to 20 carbon atoms, such as methylthio and octylthio; arylthio groups of 6 to 20 carbon atoms, such as phenylthio and naphthylthio; acyl groups of 1 to 20 carbon atoms, such as acetyl, benzoyl, and 4-chlorobenzoyl; sulfonyl groups of 1 to 20 carbon atoms, such as methanesulfonyl and benzenesulfonyl; ureido groups of 1 to 20 carbon atoms, such as methylureido and phenylureido; alkoxycarbonylamino groups of 2 to 20 carbon atoms, such as methoxycarbonylamino and hexyloxycarbonylamino; cyano groups; hydroxyl groups; nitro groups; and heterocyclic groups (heterocycles are exemplified by 5-ethoxycarbonylbenzoxazole, pyridine, sulforan, furan, pyrrole, pyrrolidine, morpholine, piperazine, pyrimidine, phthalimide, tetrachlorophthalimide, and benzisoquinolinedione rings).

In formula (II), $R^2$ represents hydrogen or an aliphatic or aromatic group. The aliphatic group and aromatic group are as defined above. $R^2$ preferably represents hydrogen or an aliphatic group, more preferably hydrogen or an alkyl group, further preferably hydrogen or an alkyl group of 1 to 15 carbon atoms, and most preferably hydrogen.

In formula (II), $R^3$ and $R^4$ independently represent hydrogen, a halogen atom, an aliphatic group, an aromatic group, —$NR^6R^7$, —$OR^6$ or —$SR^7$ wherein $R^6$ and $R^7$ independently represent hydrogen or an aliphatic or aromatic group. The aliphatic group and aromatic group are as defined above. $R^3$ and $R^4$ preferably represent hydrogen or an aliphatic group, more preferably hydrogen, an alkyl group, a substituted alkyl group, an aralkyl group or a substituted aralkyl group, further preferably hydrogen, an alkyl group or an aralkyl group, and most preferably hydrogen.

In formula (II), $R^5$ represents an aliphatic group. The aliphatic group is as defined above. Preferably, $R^5$ represents a substituted alkyl group. From the standpoint of ease of synthesis, $R^5$ is most preferably a substituted alkyl group of the same definition as —$CHR^1R^2$.

In formula (II), $L^1$, $L^2$, and $L^3$ independently represent a substituted or unsubstituted methine group. Exemplary substituents on the methine groups include halogen atoms, aliphatic groups and aromatic groups. The aliphatic group and aromatic group are as defined above. Substituents on the methine group may bond together to form an unsaturated aliphatic ring or an unsaturated heterocyclic ring. The unsaturated aliphatic ring is preferable to the unsaturated heterocyclic ring. The rings are preferably 6- or 7-membered, more preferably cycloheptene or cyclohexene rings. It is especially preferred that the methine be unsubstituted or form a cycloheptene or cyclohexene ring.

In formula (II), $Z^1$ and $Z^2$ each independently represents a group of atoms that form a 5- or 6-membered nitrogenous heterocyclic ring. Examples of the nitrogenous heterocyclic ring include oxazole, thiazole, selenazole, pyrroline, imidazole, and pyridine rings. The 5-membered rings are preferable to the 6-membered rings. An aromatic ring (e.g., benzene or naphthalene ring) may fuse to the nitrogenous heterocyclic ring. The nitrogenous heterocyclic ring or ring fused thereto may have a substituent or substituents, which are as defined above.

In formula (II), m represents 0, 1, 2 or 3.

The cyanine dye of formula (II) is preferably used in the form of a salt with an anion. Where the cyanine dye of formula (II) has an anionic group such as carboxyl or sulfo as the substituent, the dye may form an intramolecular salt. Otherwise, the cyanine dye preferably forms a salt with an anion outside its molecule. The anion is preferably mono- or divalent, more preferably monovalent. Examples of the anion include halide ions (e.g., $Cl^-$, $Br^-$ and $I^-$), p-toluenesulfonate ion, ethylsulfate ion, 1,5-disulfonaphthalene dianion, $PF_6^-$, $BF_4^-$, and $ClO^-$.

The preferred cyanine dyes are of the following formula (IIa).

(IIa)

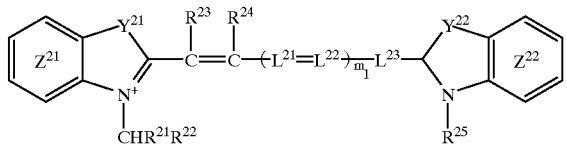

In formula (IIa), $R^{21}$, $R^{22}$, $R^{23}$ $R^{24}$, $R^{25}$, $L^{21}$, $L^{22}$, $L^{23}$, and $m_1$ are as defined for $R^1$, $R^2$, $R^3$, $R^4$, $R^5$, $L^1$, $L^2$, $L^3$, and m in formula (II), respectively.

Also in formula (IIa), $Y^{21}$ and $Y^{22}$ independently represent —$CR^{26}R^{27}$, —$NR^{26}$, —O—, —S—, or —Se—. $R^{26}$ and $R^{27}$ independently represent hydrogen or an aliphatic group, or may bond together to form a ring. The aliphatic group represented by $R^{26}$ and $R^{27}$ is preferably an alkyl group or a substituted alkyl.

In formula (IIa), the benzene ring labeled $Z^{21}$ or $Z^{22}$ may have another benzene ring fused thereto. The benzene rings $Z^{21}$ and $Z^{22}$ and the rings fused thereto may have substituents, which are as defined previously.

In formula (IIa), $m_1$ represents 0, 1, 2 or 3.

The cyanine dye of formula (IIa) is preferably used in the form of a salt with an anion. The salt formation is as discussed in conjunction with formula (II).

Illustrative, non-limiting, examples of the dye are given below.

(1)

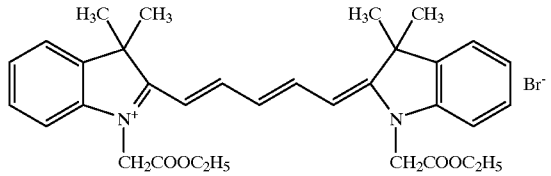

-continued
(2)
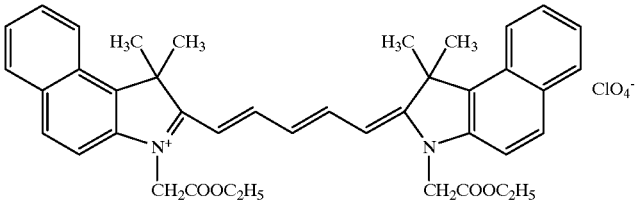
(3)
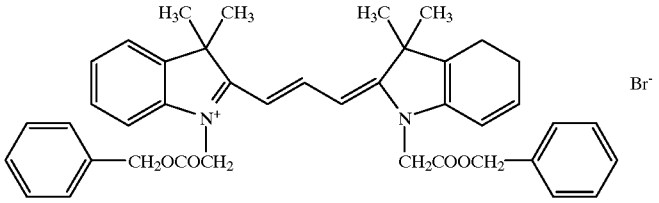
(4)
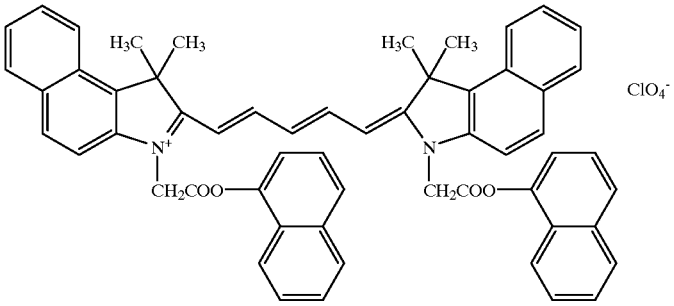
(5)
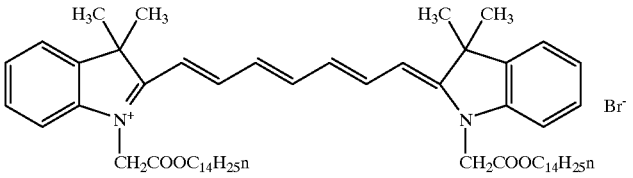
(6)
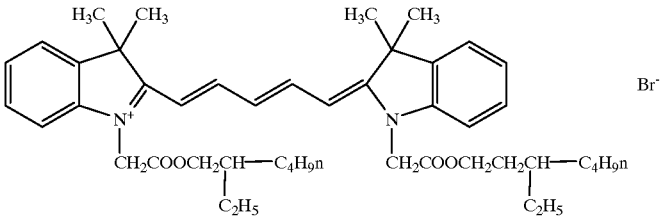
(7)
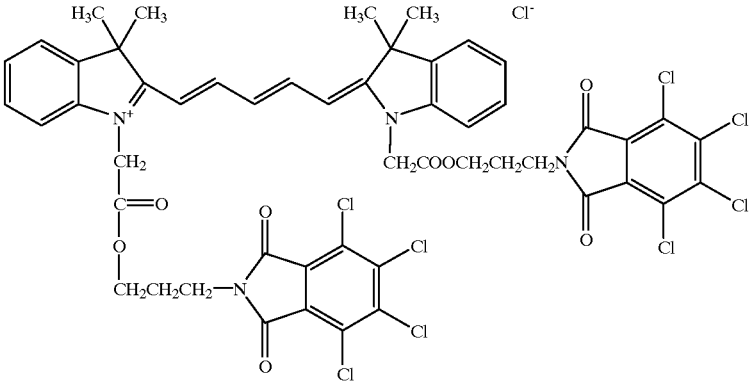

-continued
(8)
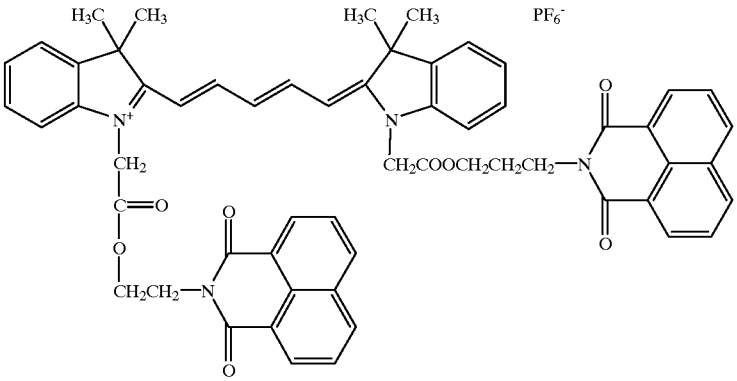
(9)
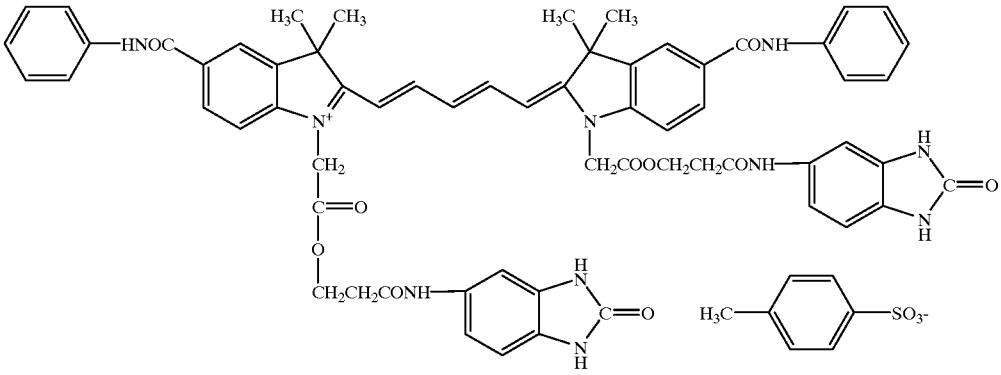
(10)
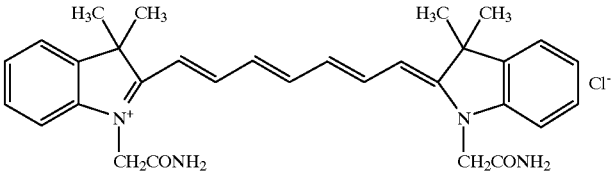
(11)
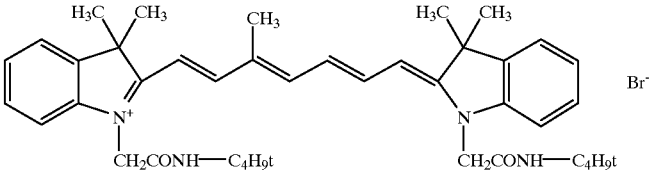
(12)
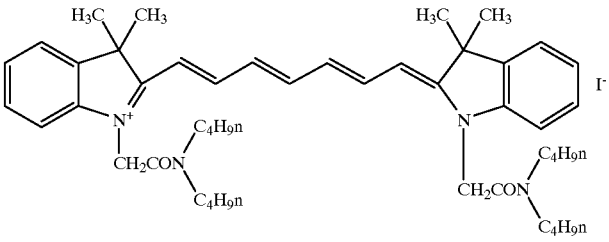

-continued
(13)
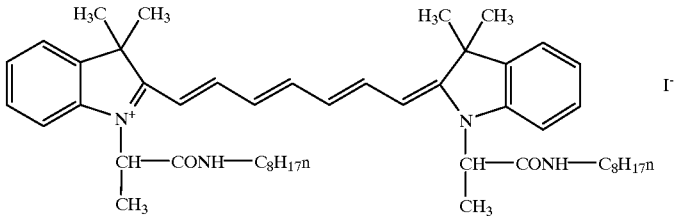
(14)
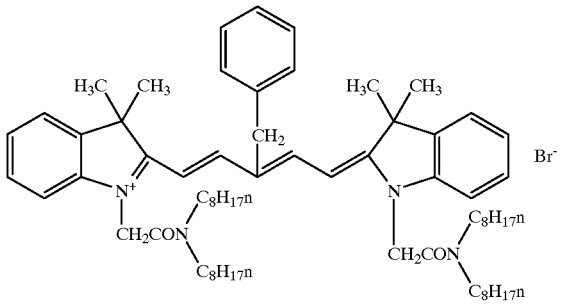
(15)
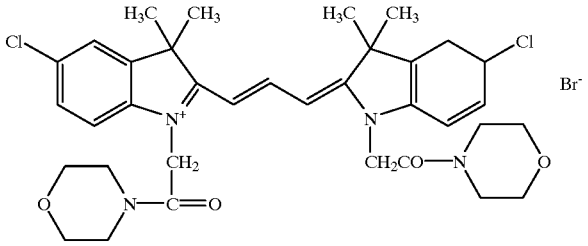
(16)
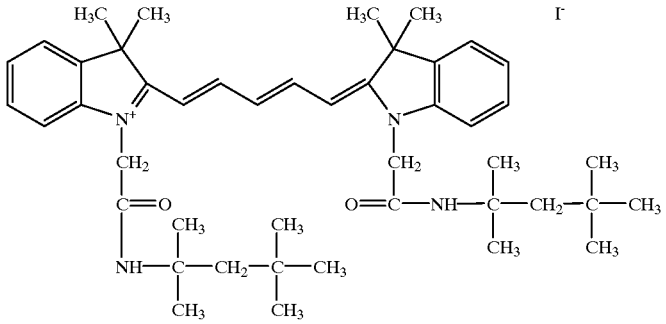
(17)
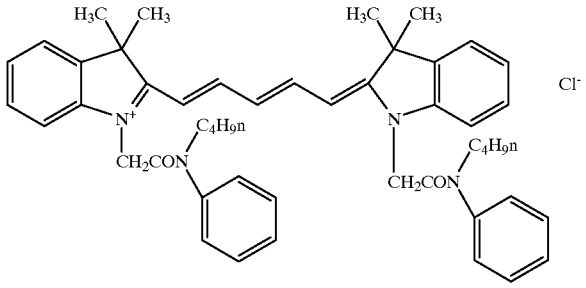

-continued
(18)
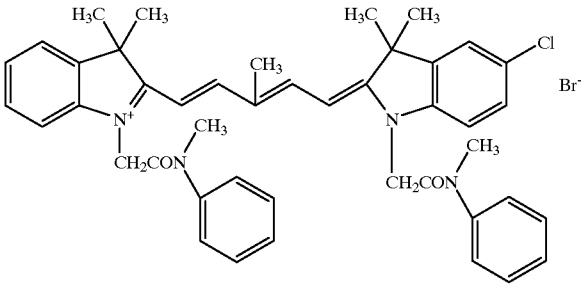
(19)
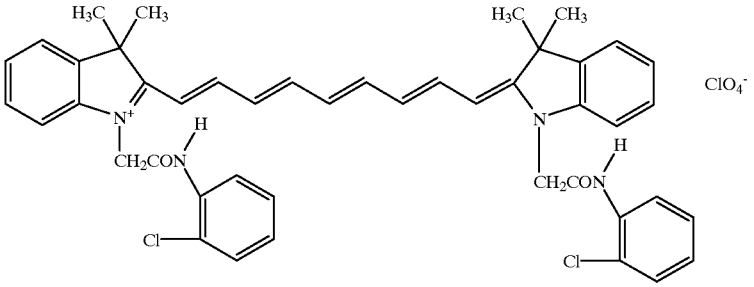
(20)
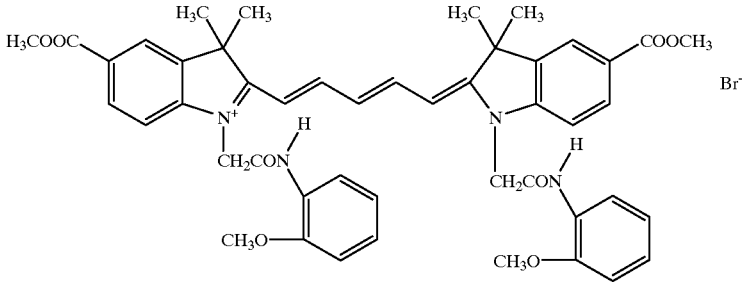
(21)
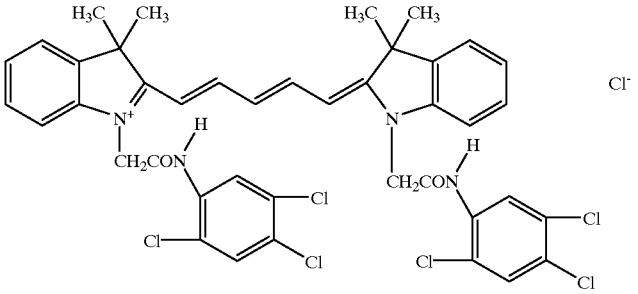
(22)
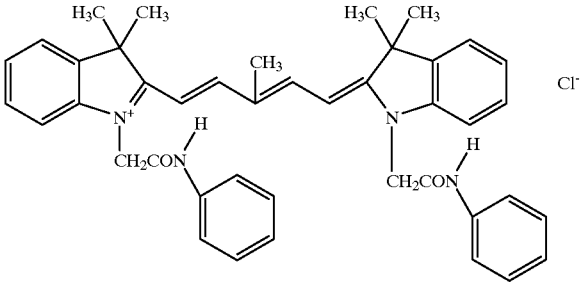

-continued
(23)
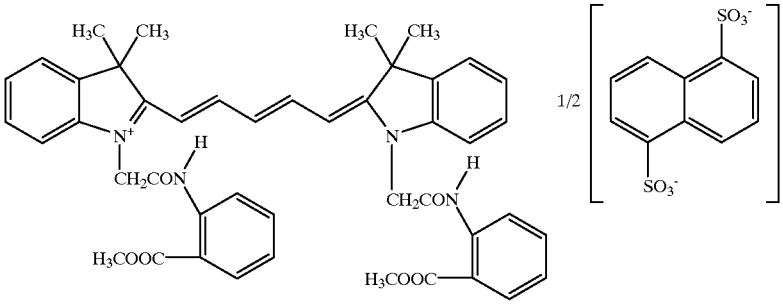
(24)
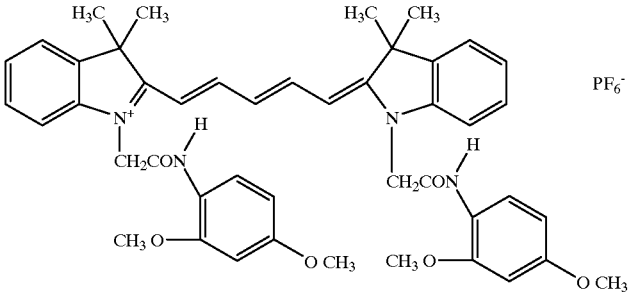
(25)
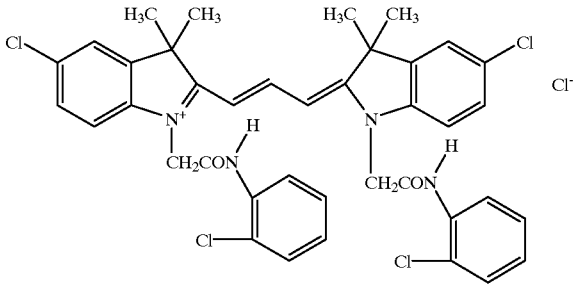
(26)
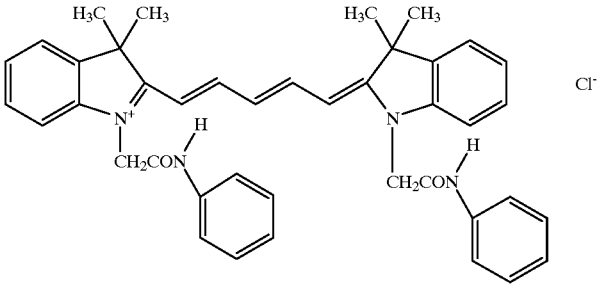
(27)
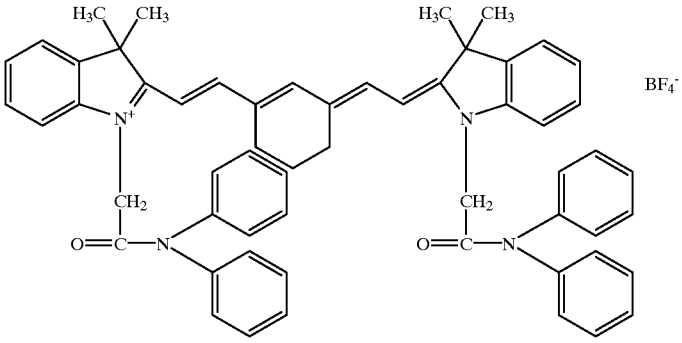

-continued
(28)
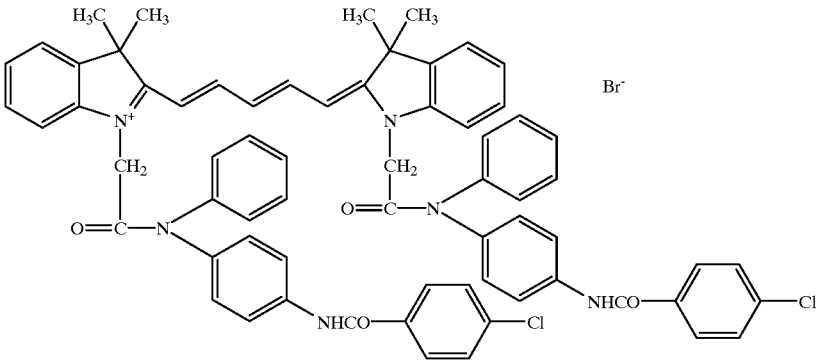
(29)
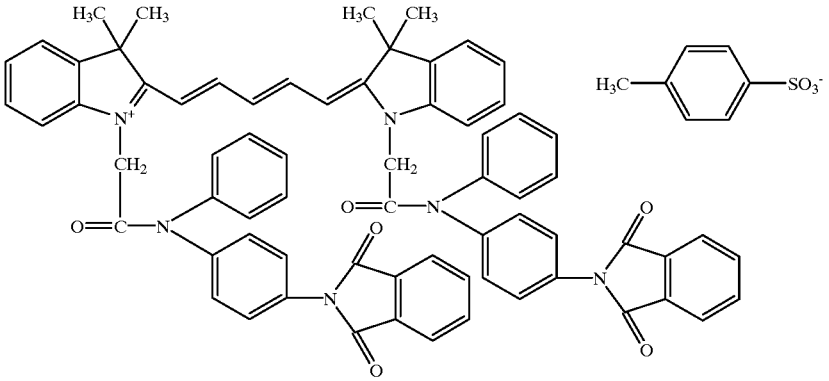
(30)
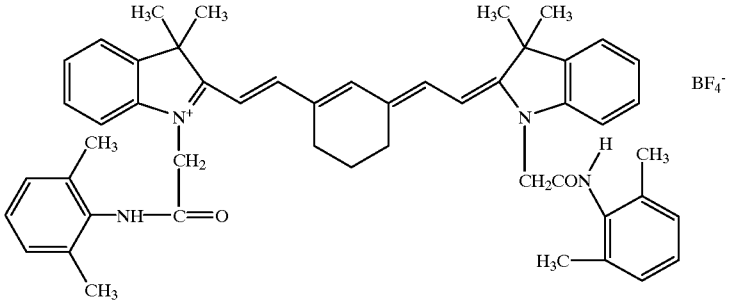
(31)
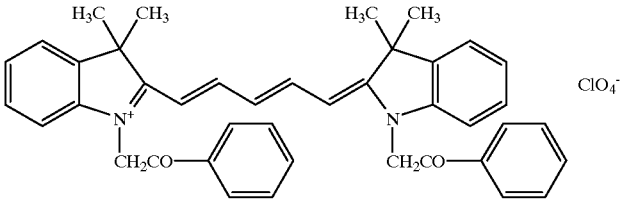
(32)
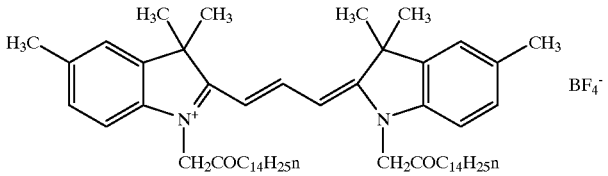

-continued
(33)
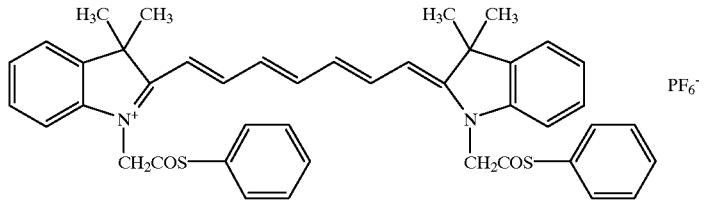
(34)
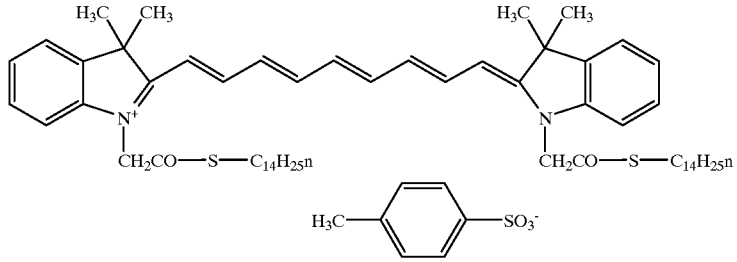
(35)
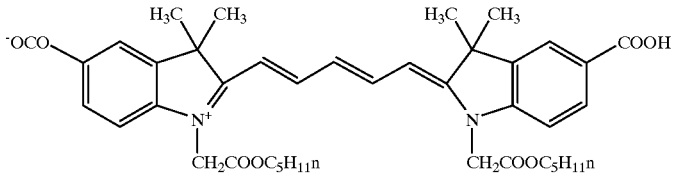
(36)
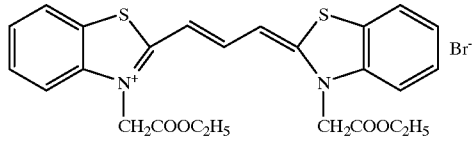
(37)
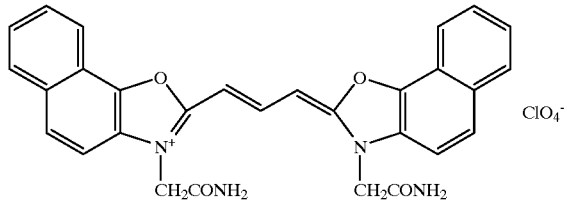
(38)
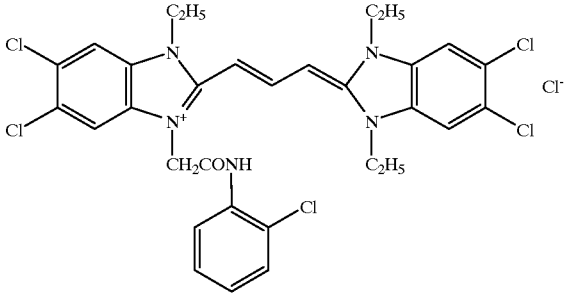

-continued (39)

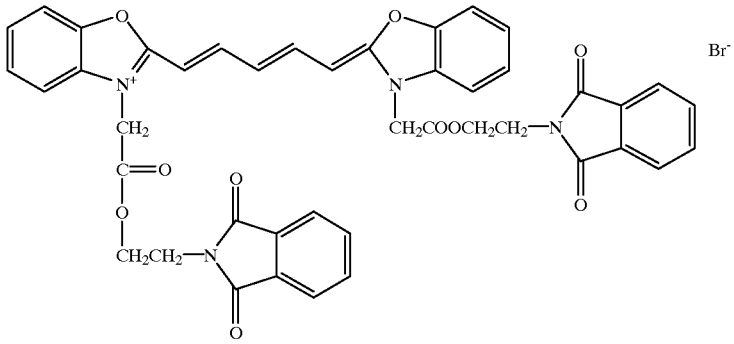

(40)

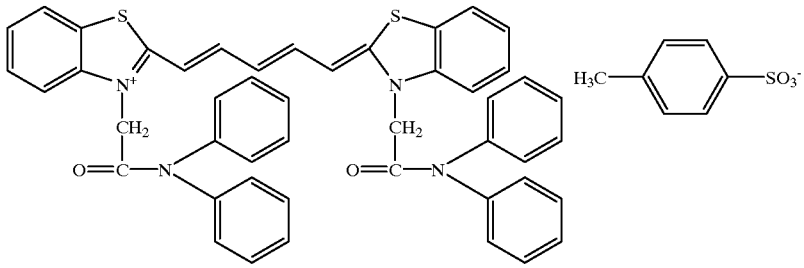

(41)

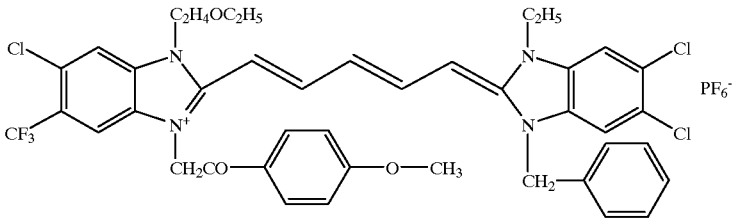

(42)

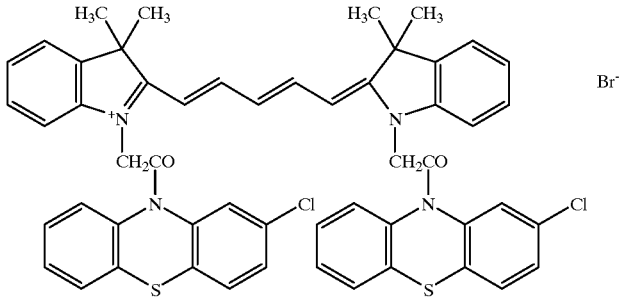

(43)

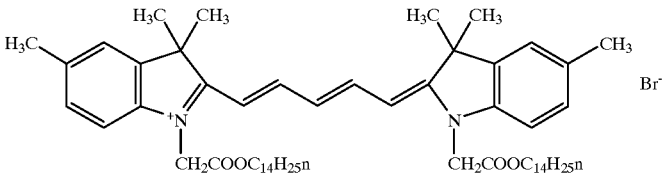

The above and other cyanine dyes can be synthesized by the methods described in JP-A 123454/1987 and 333784/1995.

Synthesis Example 1

Synthesis of Cyanine Dye (1)

A mixture of 33.4 g of ethyl bromoacetate, 15.9 g of 2,3,3-trimethylindolenine, and 30 ml of ethanol was heated under reflux for 5 hours. At the end of reaction, 50 ml of acetone and 500 ml of ethyl acetate were added whereupon a quaternary salt precipitated. The quaternary salt was collected by filtration in a yield of 25.4 g. It had a melting point of higher than 250° C.

A mixture of 16.3 g of the quaternary salt, 4.9 g of tetramethoxypropane, 75 g of N-methylpyrrolidone, 2.85 g of acetic acid, and 19.0 g of acetic anhydride was heated at 50° C. for 3 hours. At the end of reaction, 50 ml of water was added whereupon crystals precipitated. Recrystallization from methanol/isopropanol/ethyl acetate yielded 13.1 g of the crystals having a melting point of higher than 250° C., λmax of 637.5 nm, and ε of $2.16\times10^5$ in methanol.

The base-bleachable dye or a salt thereof is a compound which can be decolorized by causing a base to act thereon under heated conditions. The dye is thus also referred to as a decolorizable dye. The dye forms a substantially colorless 5- or 7-membered cyclic compound through intramolecular nucleophilic reaction. For example, when a base acts on a dye of formula (II) under heated conditions, $CHR^1R^2$ forms with $CR^3$ and $CR^4$ a 5- or 7-membered cyclic compound which is substantially colorless because the conjugation is canceled.

The resulting 5- or 7-membered cyclic compound is a substantially colorless, stable compound which can not be restored to the original dye. That is, once the dye is decolorized, it never recovers the original color.

Base Precursor

A variety of base precursors may be used herein. Since decolorization reaction is effected under heated conditions, precursors of the type that generate or release bases upon heating are preferable. Typical base precursors that generate bases upon heating are base precursors of the pyrolysis or decarboxylation type in the form of salts of carboxylic acids with bases. When a base precursor of the decarboxylation type is heated, the carboxyl group of the carboxylic acid undergoes decarboxylation to release an organic base. The carboxylic acid used herein is a decarboxylative acid such as sulfonylacetic acid or propiolic acid. The sulfonylacetic acid or propiolic acid should preferably have an aromatic group capable of promoting decarboxylation (such as aryl or unsaturated heterocyclic group) as a substituent. The base precursors in the form of sulfonylacetic acid salts are described in JP-A 168441/1984, and the base precursors in the form of propiolic acid salts are described in JP-A 180537/1984.

The base components of the decarboxylative base precursors are preferably organic bases, more preferably amidines, guanidines or derivatives thereof. The organic bases are preferably diacidic bases, triacidic bases or tetraacidic bases, more preferably diacidic bases. Diacidic bases of amidine and guanidine derivatives are most preferable.

The precursors in the form of diacidic, triacidic or tetraacidic bases of amidine derivatives are described in JP-B 59545/1995, and the precursors in the form of diacidic, triacidic or tetraacidic bases of guanidine derivatives are described in JP-B 10321/1996.

The diacidic bases of amidine and guanidine derivatives are composed of (A) two amidine or guanidine moieties, (B) substituents on the amidine or guanidine moieties, and (C) a divalent linkage group linking the two amidine or guanidine moieties. Examples of the substituents (B) include alkyl groups inclusive of cycloalkyl groups, alkenyl groups, alkynyl groups, aralkyl groups and heterocyclic residues. Two or more substituents may bond together to form a nitrogenous heterocyclic ring. The linkage group (C) is preferably an alkylene or phenylene group.

Examples of the diacidic base precursors of amidine and guanidine derivatives are given below.

(BP-1)

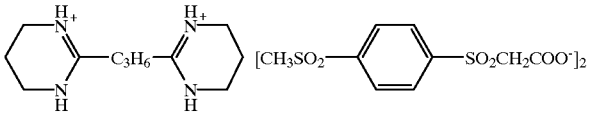

(BP-2)

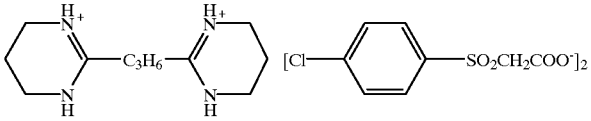

(BP-3)

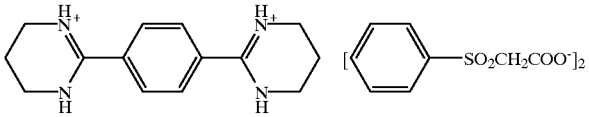

(BP-4)

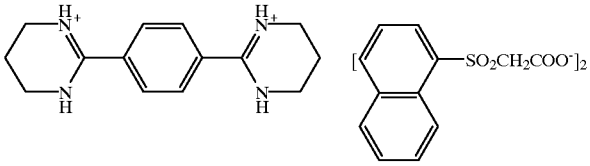

(BP-5)

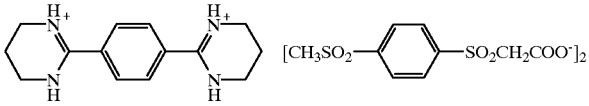

(BP-6)

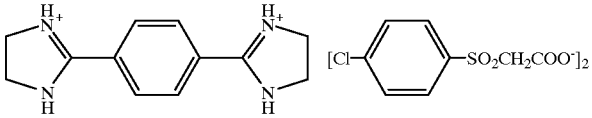

(BP-7)

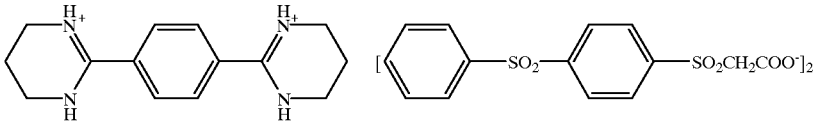

-continued
(BP-8)
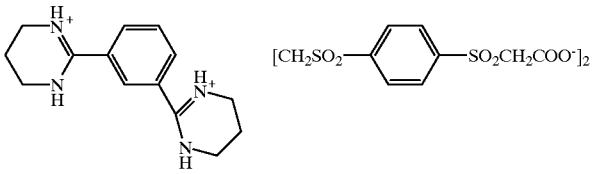
(BP-9)
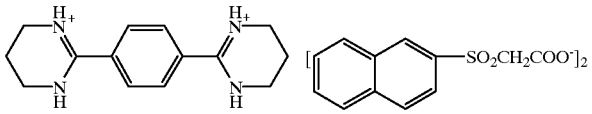
(BP-10)
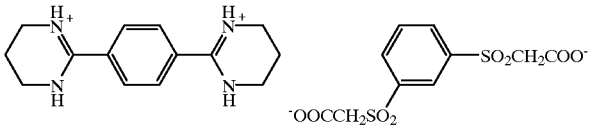
(BP-11)
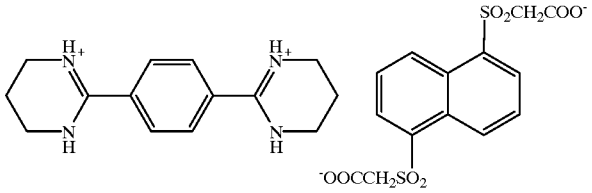
(BP-12)
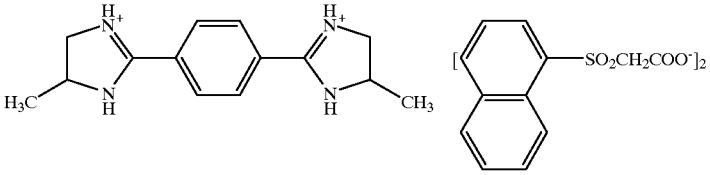
(BP-13)
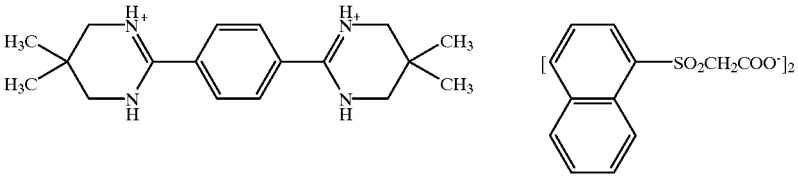
(BP-14)
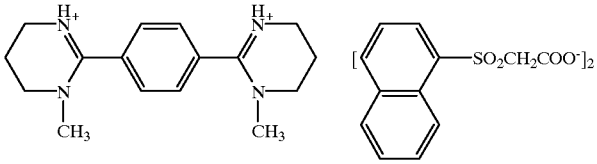
(BP-15)
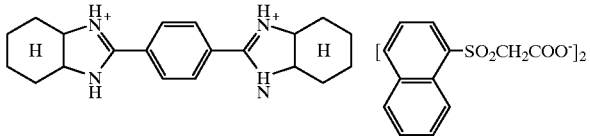
(BP-16)
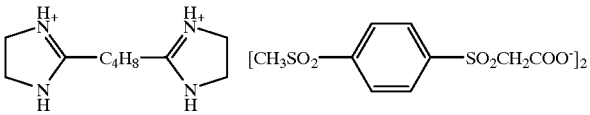
(BP-17)
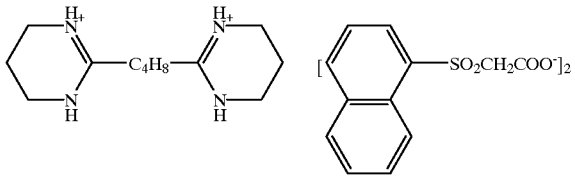
(BP-18)
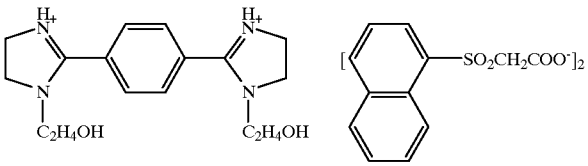
(BP-19)
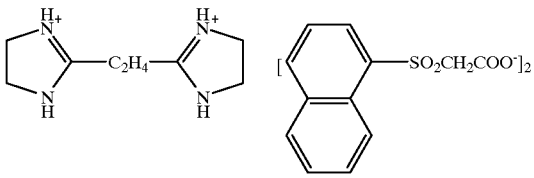

-continued
(BP-20)
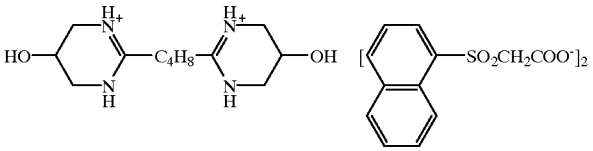
(BP-21)
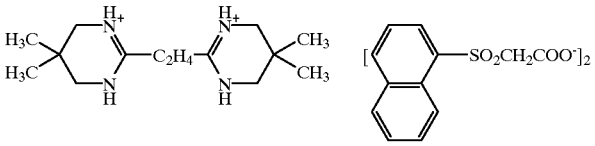
(BP-22)
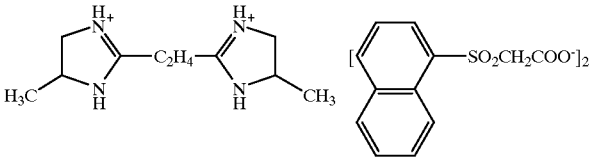
(BP-23)
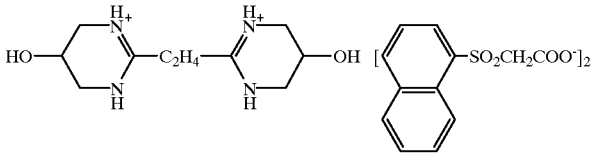
(BP-24)
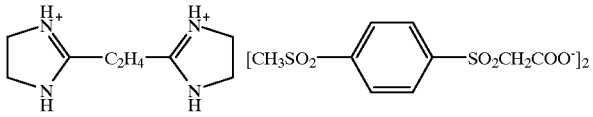
(BP-25)
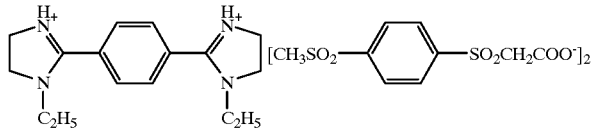
(BP-26)
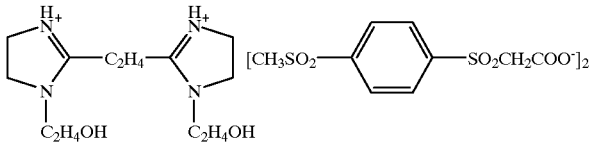
(BP-27)
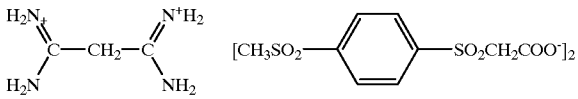
(BP-28)
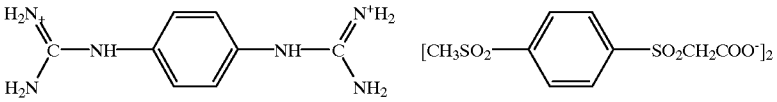
(BP-29)
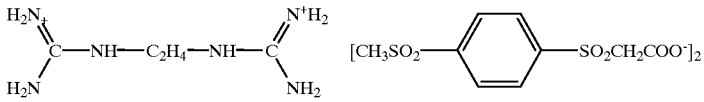
(BP-30)
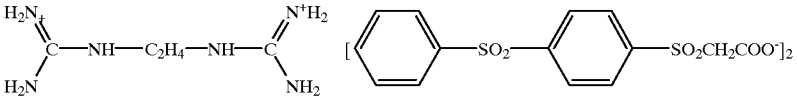
(BP-31)
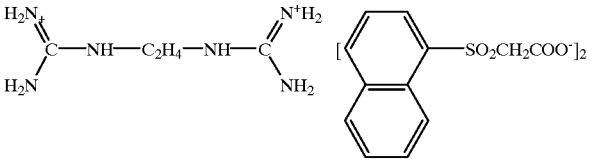
(BP-32)
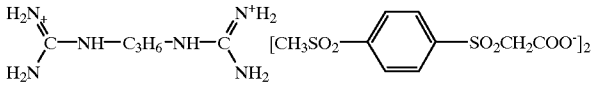
(BP-33)
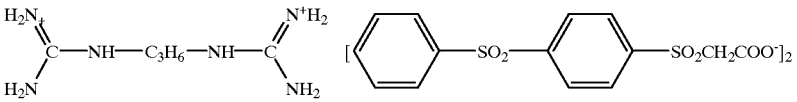

-continued (BP-34)

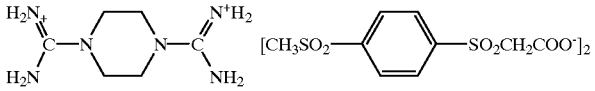

(BP-35)

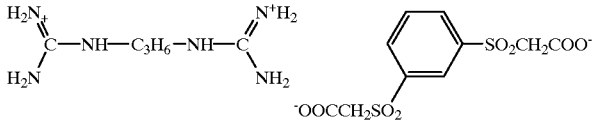

(BP-36)

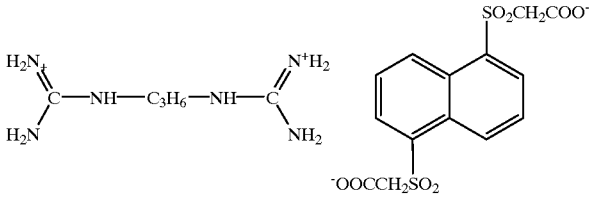

(BP-37)

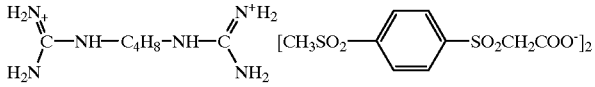

(BP-38)

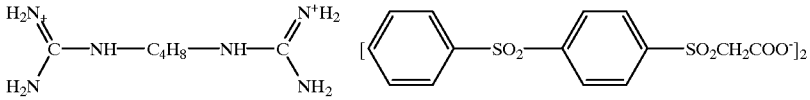

(BP-39)

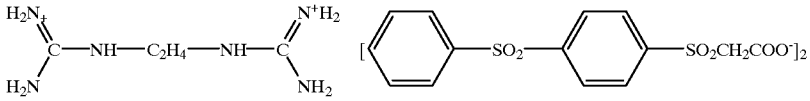

The amount (mol) of the base precursor used is preferably 1 to 100 times, more preferably 3 to 30 times, the amount (mol) of the decolorizable dye used. By utilizing the above-described decolorization reaction, the decolorizable dye can find use in a variety of applications. For example, a solution of the decolorizable dye and the base precursor can be used as a thermally decolorizable ink. Also, a transparent support coated with a solution of the decolorizable dye and the base precursor can be used as a thermally decolorizable sheet or filter.

A combination of the decolorizable dye and the base precursor can also be applied to recording media of the thermal decolorization type. The recording media of the thermal decolorization type have a recording layer on a support, typically transparent support. The decolorizable dye in a molecular or solid microparticulate form is dispersed in the recording layer. In the case of molecular form dispersion, a solution of the decolorizable dye is added to a coating solution from which the recording layer is formed. In the case of solid microparticulate form dispersion, a solid particle dispersion of the decolorizable dye is added to a coating solution from which the recording layer is formed. The base precursor is preferably dispersed in the recording layer as solid microparticulates. Preferably the recording layer further contains a binder. The preferred binders are hydrophilic polymers such as polyvinyl alcohol, gelatin, dextran, and polyacrylamide.

According to the invention, the decolorizable dye and base precursor are added to a non-photosensitive layer in the photothermographic element so that the non-photo-sensitive layer may function as a filter or anti-halation layer. In general, the photothermographic element includes a non-photosensitive layer or layers as well as a photo-sensitive layer or layers. The non-photosensitive layers are divided, in terms of their location, into four:

(1) a protective layer located on the photosensitive layer (and remote from the support), (2) an intermediate layer between photosensitive layers or between a photosensitive layer and a protective layer, (3) an undercoat layer between the photosensitive layer and the support, and (4) a back layer located on the side of the support remote from the photosensitive layer. The filter layer is incorporated in the photothermographic element as layer (1) or (2). The antihalation layer is incorporated in the photothermographic element as layer (3) or (4). The invention prefers that the non-photosensitive layer to which the decolorizable dye and base precursor are added is the back layer (4).

Preferably, the decolorizable dye and the base precursor (and the melting point depressant) are added to the same non-photosensitive layer. However, it is possible to separately add the decolorizable dye and the base precursor to two adjoining non-photosensitive layers. A barrier layer may be provided between the two non-photo-sensitive layers. In this disclosure, the phrase that "a layer contains a decolorizable dye and a base precursor (and a melting point depressant)" encompasses the provision of plural layers, that is, an embodiment wherein two adjoining layers separately contain the decolorizable dye and the base precursor. The two adjacent layers encompass the two layers between which a barrier layer is disposed.

A variety of methods may be employed for adding the decolorizable dye to a non-photosensitive layer. Typically, a solution, emulsion, solid particle dispersion or polymer impregnation of the dye is added to a coating solution of the non-photosensitive layer. Alternatively, the dye is added to the non-photosensitive layer using a polymer mordant. These addition methods are the same as the methods of adding dyes to conventional photothermographic elements. The latexes used in the polymer impregnation are described in U.S. Pat. No. 4,199,363, West German Offenlegungschrift 25141274 and 2541230, EPA 029104, and JP-B 41091/1978. And the emulsifying method for adding dyes to solutions of polymers is described in WO 88/00723.

The amount of the decolorizable dye added is determined in accordance with its purpose. Usually, the decolorizable dye is added in such an amount as to provide an optical density or absorbance of more than 0.1, preferably from 0.2 to 2, as measured at the desired wavelength. An appropriate amount of the decolorizable dye added to provide an optical density in this range is about 0.001 to 1 g/m$^2$, preferably about 0.005 to 0.8 g/m$^2$, and more preferably about 0.01 to 0.2 g/m$^2$, as expressed by a coating weight per square meter of the photothermographic element.

When the dye is decolorized according to the principle of the invention, the optical density can be lowered to or below 0.1. It is acceptable to use two or more decolorizable dyes in a recording medium of the thermal decolorization type or a photothermographic element. Similarly, two or more base precursors may be used in combination.

Other Construction

Now, the photothermographic element is described.

The photothermographic element is preferably of the mono-sheet type. That is, a single sheet of photothermographic element can form an image thereon without a need for another sheet such as an image receiving element. The invention is most effective for photothermographic elements intended for near-infrared exposure.

The photothermographic element has a photosensitive layer containing a photosensitive silver halide (i.e., a catalytic amount of photocatalyst) and preferably a reducing agent, and a non-photosensitive layer. The photosensitive layer further contains a binder (typically a synthetic polymer) and preferably an organic silver salt (or reducible silver source). Preferably it further contains a hydrazine compound as an ultrahigh contrast enhancer and a toner for controlling the tone of silver. A plurality of photo-sensitive layers may be provided. For example, the photothermographic element may be provided with a high sensitivity photosensitive layer and a low sensitivity photosensitive layer for the purpose of adjusting gradation. With respect to the arrangement of high and low sensitivity photosensitive layers, either one of the low and high sensitivity photosensitive layers may be located below the other or nearer to the support.

The non-photosensitive layer may be the dye-containing layer, that is, filter or antihalation layer as described above while it may also be provided as another functional layer such as a surface protecting layer.

Support

The support of the photothermographic element may be selected from paper, polyethylene-laminated paper, polypropylene-laminated paper, parchment, fabric, sheets or films of metals (e.g., aluminum, copper, magnesium and zinc), glass, glass coated with metals (e.g., chromium alloys, steel, silver, gold and platinum), and plastic films. Examples of the plastic materials of which the support is made include polyalkyl methacrylates (e.g., polymethyl methacrylate), polyesters (e.g., polyethylene terephthalate PET), polyvinyl acetal, polyamides (e.g., nylon), and cellulose esters (e.g., cellulose nitrate, cellulose acetate, cellulose acetate propionate, and cellulose acetate butyrate).

The support may be coated with a polymer. Exemplary polymers for the coating purpose are polyvinylidene chloride, acrylic acid polymers (e.g., polyacrylonitrile and methyl acrylate), polymers of unsaturated dicarboxylic acids (e.g., itaconic acid and acrylic acid), carboxymethyl cellulose, and polyacrylamides. Copolymers are also useful. Alternatively, the support may be provided with a subbing layer containing such a polymer instead of coating with a polymer.

Silver Halide

The silver halide used herein may be any of silver bromide, silver iodide, silver chloride, silver chlorobromide, silver iodobromide, and silver chloroiodobromide. The amount of silver halide added is preferably 0.03 to 0.6 g/m$^2$, more preferably 0.05 to 0.4 g/m$^2$, and most preferably 0.1 to 0.4 g/m$^2$. The silver halide is generally prepared as a silver halide emulsion by reaction of silver nitrate with a soluble halide. The silver halide may also be prepared by reacting a silver soap with a halide ion for halogen conversion of the soap moiety of the silver soap. Furthermore, a halide ion may be added during formation of the silver soap.

Reducing Agent

The reducing agent used herein is preferably selected from Phenidone®, hydroquinones, catechol, and hindered phenols. The reducing agents are described in U.S. Pat. Nos. 3,770,448, 3,773,512, 3,593,863, and 4,460,681, and *Research Disclosure,* Nos. 17029 and 29963.

Examples of the reducing agent include aminohydroxycycloalkenone compounds (e.g., 2-hydroxy-piperidino-2-cyclohexenone), N-hydroxyurea derivatives (e.g., N-p-methylphenyl-N-hydroxyurea), aldehyde or ketone hydrazones (e.g., anthracenealdehyde phenylhydrazone), phosphoramidophenols, phosphoramidoanilines, polyhydroxybenzenes (e.g., hydroquinone, t-butylhydroquinone, isopropylhydroquinone, and 2,5-dihydroxyphenylmethylsulfone), sulfohydroxamic acids (e.g., benzenesulfohydroxamic acid), sulfonamidoanilines (e.g., 4-(N-methanesulfonamido)aniline), 2-tetrazolylthiohydroquinones (e.g., 2-methyl-5-(1-phenyl-5-tetrazolylthio)hydroquinone), tetrahydroquinoxalines (e.g., 1,2,3,4-tetrahydroquinoxaline), amidoxines, combinations of azines (e.g., aliphatic carboxylic acid aryl hydrazides) with ascorbic acid, a combination of polyhydroxybenzene with hydroxylamine, reductone, hydrazines, hydroxamic acids, combinations of azines with sulfonamidophenols, α-cyanophenylacetic acid derivatives, combinations of bis-β-naphthol with 1,3-dihydroxybenzene derivatives, 5-pyrazolones, sulfonamidophenols, 2-phenylindane-1,3-dione, chroman, 1,4-dihydropyridines (e.g., 2,6-dimethoxy-3,5-dicarboethoxy-1,4-dihydropyridine), bisphenols (e.g., bis(2-hydroxy-3-t-butyl-5-methylphenyl)methane, bis(6-hydroxy-m-tri)mesitol, 2,2-bis(4-hydroxy-3-methylphenyl)propane, and 4,4-ethylidene-bis(2-t-butyl-6-methyl)phenol), UV-sensitive ascorbic acid derivatives, and 3-pyrazolidones.

Other useful reducing agents are aminoreductone esters (e.g., piperidinohexosereductone monoacetate) functioning as a reducing agent precursor.

The most preferred reducing agents are hindered phenols.

The amount of the reducing agent added is preferably 0.01 to 5.0 g/m$^2$, more preferably 0.1 to 3.0 g/m$^2$.

Binder

In one preferred embodiment, the photosensitive and non-photosensitive layers contain binders. The binders used herein are, often, colorless, transparent or translucent polymers. Natural or semi-synthetic polymers such as gelatin, gum arabic, hydroxyethyl cellulose, cellulose esters, casein, and starch may be used although synthetic polymers are preferable to natural or semi-synthetic polymers from the heat resistance standpoint. However, cellulose esters such as cellulose acetate and cellulose acetate butyrate are advantageously employed as the binder in the photothermographic element because they are relatively heat resistant though they are semi-synthetic polymers.

Examples of the synthetic polymer used herein include polyvinyl alcohol, polyvinyl pyrrolidone, polyacrylic acid, polymethyl methacrylate, polyvinyl chloride, polymethacrylic acid, styrene/maleic anhydride copolymers, styrene/acrylonitrile copolymers, styrene/butadiene copolymers, polyvinyl acetals (e.g., polyvinyl formal and polyvinyl butyral), polyesters, polyurethanes, phenoxy resins, polyvinylidene chloride, polyepoxides, polycarbonates, polyvinyl acetate, and polyamides. Hydrophobic polymers are preferable to hydrophilic polymers. Therefore, styrene/acrylonitrile copolymers, styrene/butadiene copolymers, polyvinyl acetal, polyesters, polyurethanes, cellulose acetate butyrate, polyacrylic acid, polymethyl methacrylate, polyvinyl chloride, and polyurethanes are preferred, with the styrene/butadiene copolymers and polyvinyl acetal being more preferred.

The binder is used after it is dissolved or emulsified in a solvent (which is water or organic solvent) of a coating solution from which a layer is formed. When the binder is emulsified in the coating solution, it is acceptable to mix an emulsion of the binder with the coating solution.

As the binder in the photosensitive layer, it is preferred to apply an aqueous coating medium of a polymer latex. The amount of the binder used in the photosensitive layer is preferably 0.2 to 30 g/m$^2$, more preferably 1 to 15 g/m$^2$.

The amount of the binder used in the layer containing the decolorizable dye is preferably adjusted such that the dye may be present in an amount of 0.1 to 60% by weight of the binder. More preferably, the decolorizable dye is present in an amount of 0.2 to 30%, especially 0.5 to 10% by weight of the binder.

Organic Silver Salt

In one preferred embodiment, the photosensitive or non-photosensitive layer contains an organic silver salt. The organic acids capable of forming silver salts are preferably long-chain fatty acids. The fatty acids preferably have 10 to 30 carbon atoms, especially 15 to 25 carbon atoms. Organic silver salt complexes are also useful. The ligands of the complexes should preferably have an overall stability constant of 4.0 to 10.0 relative to silver ion. With respect to the organic silver salts, reference should be made to *Research Disclosure,* Nos. 17029 and 29963.

Examples of the organic silver salt include silver salts of fatty acids (e.g., gallic acid, oxalic acid, behenic acid, stearic acid, palmitic acid, and lauric acid), silver salts of carboxyalkylthioureas (e.g., 1-(3-carboxypropyl)thiourea and 1-(3-carboxypropyl)-3,3-dimethylthiourea), silver complexes of polymeric reaction products of aldehydes (e.g., formaldehyde, acetaldehyde, and butylaldehyde) with hydroxy-substituted aromatic carboxylic acids, silver salts of aromatic carboxylic acids (e.g., salicylic acid, benzoic acid, 3,5-dihydroxybenzoic acid, and 5,5-thiodisalicylic acid), silver salts or complexes of thioenes (e.g., 3-(2-carboxyethyl)-4-hydroxymethyl-4-thiazoline-2-thioene and 3-carboxymethyl-4-thiazoline-2-thioene), silver salts or complexes of nitrogenous acids (e.g., imidazole, pyrazole, urazole, 1,2,4-thiazole, 1H-tetrazole, 3-amino-5-benzylthio-1,2,4-triazole, and benzotriazole), a silver salt of saccharin, a silver salt of 5-chlorosalicylaldoxime, and silver salts of mercaptides. Silver behenate is most preferred. The amount of the organic silver salt used is preferably 0.05 to 3 g/m$^2$, more preferably 0.3 to 2 g/m$^2$, calculated as silver.

Preferably, the photosensitive or non-photosensitive layer further contains an ultrahigh contrast enhancer. For the photothermographic element used in the printing photography field, halftone reproduction of continuous tone images or line copies is crucial. The use of ultrahigh contrast enhancers is effective for improving the reproduction of halftone images or line copies. The ultrahigh contrast enhancers used herein include hydrazine compounds, quaternary ammonium compounds, and acrylonitrile compounds as described in U.S. Pat. No. 5,545,515. Hydrazine compounds are the most preferred ultrahigh contrast enhancers.

The hydrazine compounds include hydrazine ($H_2N$-$NH_2$) and analogous compounds having a substituent for at least one of the hydrogen atoms. The substituents are aliphatic, aromatic or heterocyclic groups each directly attached to the nitrogen atom of hydrazine, or aliphatic, aromatic or heterocyclic groups each attached to the nitrogen atom of hydrazine via a linking group. Exemplary linking groups are —CO—, —CS—, —$SO_2$—, —POR—, —CNH— and mixtures thereof, wherein R is an aliphatic, aromatic or heterocyclic group.

The hydrazine compounds are described in U.S. Pat. Nos. 5,464,738, 5,496,695, 5,512,411, 5,536,622, JP-B 77138/1994, 93082/1994, JP-A 230497/1994, 289520/1994, 313951/1994, 5610/1995, 77783/1995, and 104426/1995.

The hydrazine compounds are dissolved in suitable organic solvents before they are added to the coating solution for the photosensitive layer. Exemplary organic solvents include alcohols (e.g., methanol, ethanol, propanol, and fluorinated alcohols), ketones (e.g., acetone, methyl ethyl ketone), dimethylformamide, dimethyl sulfoxide, and methyl cellosolve. Alternatively, the hydrazine compound is dissolved in an oily or auxiliary solvent to form a solution, which is emulsified in the coating solution. Exemplary oily solvents include dibutyl phthalate, tricresyl phosphate, glyceryl triacetate, diethyl phthalate, ethyl acetate, and cyclohexanone. Furthermore, a solid particle dispersion of the hydrazine compound may be added to the coating solution. The hydrazine compound may be dispersed using any of well-known dispersing machines such as a ball mill, colloid mill, Manton Gaulin, micro-fluidizer or ultrasonic dispersing machine.

The contrast enhancer is preferably added in an amount of $1\times10^{-6}$ to $1\times10^{-2}$ mol, more preferably $1\times10^{-5}$ to $5\times10^{-3}$ mol, most preferably $2\times10^{-5}$ to $5\times10^{-3}$ mol, per mol of silver halide.

In addition to the contrast enhancer, a contrast enhancement accelerator may be used. Exemplary accelerators include amine compounds (U.S. Pat. No. 5,545,505), hydroxamic acids (U.S. Pat. No. 5,545,507), acrylonitriles (U.S. Pat. No. 5,545,507), and hydrazine compounds (U.S. Pat. No. 5,558,983).

Preferably, the photosensitive or non-photosensitive layer further contains a toner. The toners are described in *Research Disclosure* No. 17029. Examples of toners include: imides such as phthalimide; cyclic imides such as succinimide; pyrazolin-5-ones such as 3-phenyl-2-pyrazolin-5-one and 1-phenylurazole; quinazolinones such as quinazoline and 2,4-thiazolidinedione; naphthalimides such as N-hydroxy-1,8-naphthalimide; cobalt complexes such as cobaltic hexamine trifluoroacetate; mercaptans such as 3-mercapto-1,2,4-triazole; N-(aminomethyl) aryldicarboximides such as N-(dimethylaminomethyl) phthalimide; a combination of blocked pyrazoles, isothiuronium derivatives, and certain photo-bleach agents, such as a combination of N,N'-hexamethylene-1-carbamoyl-3,5-dimethylpyrazole, 1,8-(3,6-dioxaoctane)bis(isothiuronium) trifluoroacetate, and 2-(tribromomethylsulfonyl) benzothiazole; merocyanine dyes such as 3-ethyl-5-[(3-ethyl-2-benzothiazolinylidene)-1-methylethylidene]-2-thio-2,4-oxazolidinedione; phthalazinone compounds or metal salts thereof, such as phthalazinone, 4-(1-naphthyl) phthalazinone, 6-chlorophthalazinone, 5,7-dimethyloxyphthalazinone, and 2,3-dihydro-1,4-phthalazinedione, and 8-methylphthalazinone; a combination of phthalazinones and sulfinic acid derivatives (e.g., sodium benzenesulfinate); a combination of phthalazinones and sulfonic acid derivatives (e.g., sodium p-toluenesulfonate); phthalazine and derivatives thereof such as phthalazine, 6-isopropylphthalazine, and 6-methylphthalazine; a combination of phthalazines and phthalic acid; a combination of phthalazine or phthalazine adducts and dicarboxylic acids (preferably o-phenylenic acid) or anhydrides thereof (e.g., maleic anhydride, phthalic acid, 2,3-naphthalenedicarboxylic acid, phthalic anhydride, 4-methylphthalic acid, 4-nitrophthalic acid, and tetrachlorophthalic anhydride); quinazolinediones, benzoxazine or naphthoxazine derivatives; benzoxazine-2,4-diones such as 1,3-benzoxazine-2,4-dione; pyrimidines; asym-triazines such as 2,4-dihydroxypyrimidine; and tetraazapentalene derivatives, such as 3,6-dimercapto-1,4-diphenyl-1H,4H-2,3a,5,6a-tetraazapentalene. Phthalazines are especially preferred. The toner is preferably contained on the image forming layer side in an amount of 0.1 to 50 mol %, especially 0.5 to 20 mol % per mol of silver.

Antifoggants may be added to the photosensitive layer or non-photosensitive layer, preferably to the photo-sensitive layer. The preferred antifoggants are non-mercury compounds as described in U.S. Pat. Nos. 3,874,946, 4,546,075, 4,452,885, 4,756,999, 5,028,523, British Patent Application Nos. 92221383.4, 9300147.7, and 9311790.1, and JP-A 32015/1978, 12581/1980, 57234/1984, and 292125/1988 rather than mercury compounds as described in U.S. Pat. No. 3,589,903. Heterocyclic compounds having halo-substituted methyl groups (halogen is F, Cl, Br or I) are especially preferred as the antifoggant.

Usually the silver halide is used after it is spectrally sensitized. Spectral sensitizing dyes are described in JP-A 140335/1985, 159841/1988, 231437/1938, 259651/1988, 304242/1988, 15245/1988, U.S. Pat. Nos. 4,639,414, 4,740,455, 4,741,966, 4,751,175, and 4,835,096.

In the photothermographic element, surfactants, antioxidants, stabilizers, plasticizers, UV absorbers, and coating acids may be added. These additives may be added to either the photosensitive layer or the non-photosensitive layer.

With respect to the technology (relating to silver halides, organic silver salts, reducing agents, binders and other components) applicable to the photothermographic element of the invention, reference should also be made to the following patents:

EP 803764 A1, EP 883022 A1,
WO 98/36322,

| Japanese Patent | Application Kokai | (JP-A) Nos. |
|---|---|---|
| 281637/1997 | 297367/1997 | 304869/1997 |
| 311405/1997 | 329865/1997 | 10669/1998 |
| 62899/1998 | 69023/1998 | 186568/1998 |
| 90823/1998 | 171063/1998 | 186565/1998 |
| 186567/1998 | 186569/1998 | 186570/1998 |
| 186571/1998 | 186572/1998 | 197974/1998 |
| 197982/1998 | 197983/1998 | 197985/1998 |
| 197986/1998 | 197987/1998 | 207001/1998 |
| 207004/1998 | 221807/1998 | 282601/1998 |
| 288823/1998 | 288824/1998 | 307365/1998 |
| 312038/1998 | 339934/1998 | 7100/1999 |
| 15105/1999 | 24200/1999 | 24201/1999 |
| 30832/1999 | | |

In the photothermographic element, images are formed by imagewise exposure followed by heating. This heat development forms black silver images. Imagewise exposure is preferably effected using a laser. The heating temperature for heat development is preferably 80 to 250° C., more preferably 100 to 200° C. The heating time is usually 1 second to 2 minutes.

A plate heater system is preferably employed for heat development. The plate heater system for heat development is described in Japanese Patent Application Nos. 229684/1997 and 177610/1998. A photothermographic element having a latent image formed therein is contacted with a heating means in a heat development section whereby a visible image is produced. The heating means is a plate heater, on one surface of which are arranged a plurality of guide rollers. The element is passed between the guide rollers and the plate heater to carry out heat development.

Figure 2:
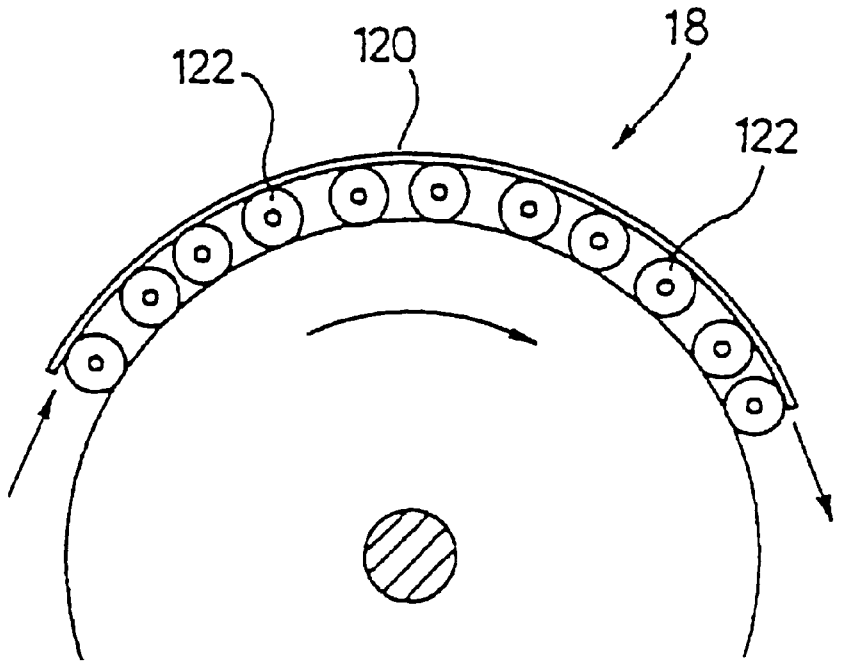

Referring to FIGS. 1 and 2, there are illustrated typical plate heater development systems.

A sheet of photothermographic element is conveyed to an exposure section (not shown) where it is scanned with a laser beam for exposure. As a result, a latent image is formed in the sheet. The sheet is conveyed to a heat development section 18 after it is passed between cleaning rollers for removing dust and foreign matter from the front and rear surfaces of the sheet.

The development section 18 is to heat the sheet of photothermographic element for heat development to convert the latent image to a visible image. The development section 18 includes a curved plate heater 120 and a plurality of parallel guide rollers 122 arranged along one surface of the plate heater 120. The plate heater 120 is a planar heating member having a heater (e.g., Nichrome wire) embedded therein and maintains a temperature for the development of the photothermographic element. The plate heater 120 on its surface may be coated with a fluoro resin or covered with a sheet of fluoro resin for the purpose of reducing frictional resistance or imparting wear resistance.

During heat development, volatile components can evaporate from the photothermographic element sheet so that the sheet may become afloat from the plate heater 120. That is, the contact between the sheet and the plate heater 120 can become uneven. The surface of the plate heater 120 is preferably formed with fine irregularities to provide an escape for such vapors. Further, to compensate for temperature drops at opposite ends of the plate heater 120 due to heat release, the plate heater 120 is preferably provided with a temperature profile such that the temperature at the ends is higher than in the remaining portion.

The guide rollers 122 are arranged over the entire surface of the plate heater 120 in substantial contact therewith or with a spacing smaller than the thickness of the sheet, at a suitable pitch and in the conveying direction. The guide rollers 122 form with the plate heater 120 a path for conveying the sheet. The spacing of this path is made smaller than the thickness of the sheet for preventing the sheet from buckling.

In FIG. 1, a pair of feed rollers 126 are disposed at the entrance of the path for feeding the sheet into the heat developing section 18 as shown by an arrow, and a pair of discharge rollers 128 are disposed at the exit of the path for delivering the developed sheet as shown by an arrow. A heat insulating cover 125 is extended over the guide rollers 122 on the opposite side to the plate heater 120.

During transportation of the photothermographic element sheet through the path, the sheet is momentarily stopped when its leading edge abuts against any one of the guide rollers 122. If the guide rollers 122 are spaced at an equal pitch, the same portion of the sheet is stopped at every guide roller 122 and that portion is kept in contact with the plate heater 120 for a longer time. Consequently, the sheet undergoes development variation in the form of transversely extending streaks. To avoid such inconvenience, the guide rollers 122 are preferably arranged at irregular pitches.

In FIG. 2, a drive drum 130 is disposed inside and in contact with the guide rollers 122 such that the circumference of the drum 130 may coincide with the enveloping surface of the guide rollers 122. The guide rollers 122 are rotated about their axis by driving the drum 130 in the arrow direction.

It is noted that the plate heater 120 may also consist of a planar member of heat transfer material and a heat source disposed on the back side of the member opposite to the photothermographic element sheet.

EXAMPLE

Examples of the invention are given below by way of illustration and not by way of limitation.

Example 1

Silver Halide Emulsion 1

A solution was obtained in a titanium-lined stainless steel reactor by adding 6.7 ml of a 1 wt % potassium bromide solution to 1421 ml of distilled water, and further adding 8.2 ml of 1N nitric acid and 21.8 g of phthalated gelatin. In the reactor, the solution was stirred and maintained at 37° C. There were furnished a solution A of 37.04 g of silver nitrate diluted with distilled water to a volume of 159 ml and a solution B of 32.6 g of potassium bromide diluted with distilled water to a volume of 200 ml. The entirety of solution A was added at a constant flow rate over one minute by the controlled double jet method while maintaining the solution at pAg 8.1. (Solution B was added by the controlled double jet method.) Thereafter, 30 ml of a 3.5% hydrogen peroxide aqueous solution was added and 36 ml of a 3 wt % aqueous solution of Compound 1 added. There were further furnished a solution A2 obtained by diluting solution A with distilled water to a volume of 317.5 ml and a solution B2 obtained by dissolving Compound 2 to solution B so as to finally become $1\times10^{-4}$ mol per mol of silver, and diluting with distilled water to a volume of 400 ml, that is twice the volume of solution B. The entirety of solution A2 was added at a constant flow rate over 10 minutes yet by the controlled double jet method while maintaining the solution at pAg 8.1. (Solution B2 was added by the controlled double jet method.) Thereafter, 50 ml of a 0.5 wt % methanol solution of Compound 3 was added to the dispersion, which was adjusted to pAg 7.5 with silver nitrate and then to pH 3.8 with 1N sulfuric acid. Agitation was stopped at this point. After flocculation, desalting, and water washing, 3.5 g of deionized gelatin was added and 1N sodium hydroxide added. Adjustment to pH 6.0 and pAg 8.2 yielded a silver halide dispersion.

The grains in this silver halide emulsion were pure silver bromide grains having a mean equivalent spherical diameter of 0.05 $\mu$m and a coefficient of variation of equivalent spherical diameter of 18%. The grain size was determined from an average of 1000 grains in a photomicrograph. The grains had a {100} face proportion of 85% as determined by Kubelka-Munk method.

The emulsion was heated at 50° C. with stirring, to which 5 ml of a 0.5 wt % solution of Compound 4 and 5 ml of a 3.5 wt % solution of Compound 5 were added, and after one minute, $3\times10^{-5}$ mol per mol of silver of Compound 6 was added. After 2 minutes, $5\times10^{-3}$ mol per mol of silver of a solid dispersion of Spectral Sensitizing Dye A (in gelatin aqueous solution) was added. After 2 minutes, $5\times10^{-5}$ mol per mol of silver of Tellurium Sensitizer B was further added to the emulsion, which was ripened for 50 minutes. Nearly the end of ripening, $1\times10^{-3}$ mol per mol of silver of Compound 3 was added. The emulsion was cooled to terminate chemical sensitization, obtaining Silver Halide Emulsion 1.

Compound 1

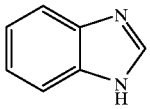

Compound 2

$K_3IrCl_6$

Compound 3

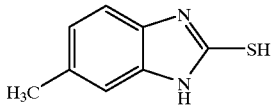

Compound 4

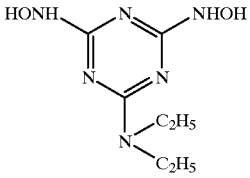

Compound 5

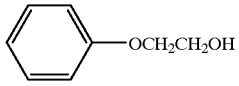

Compound 6

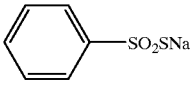

Spectral Sensitizer A

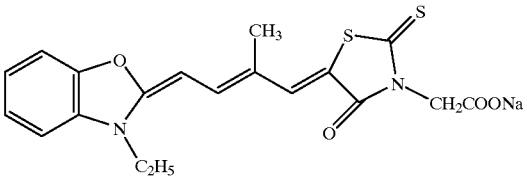

Tellurium Sensitizer B

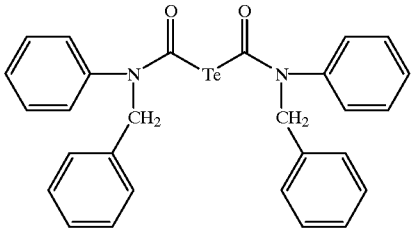

Silver Halide Emulsion 2

In 700 ml of water were dissolved 22 g of phthalated gelatin and 30 mg of potassium bromide. The solution was adjusted to pH 5.0 at a temperature of 40° C. To the solution, 159 ml of an aqueous solution containing 18.6 g of silver nitrate and an aqueous solution of potassium bromide were added over 10 minutes by the controlled double jet method while maintaining the solution at pAg 7.7. Then, 476 ml of an aqueous solution containing 55.4 g of silver nitrate and an aqueous halide solution containing 8 $\mu$mol/liter of dipotassium hexachloroiridate and 1 mol/liter of potassium bromide were added over 30 minutes by the controlled double jet method while maintaining the solution at pAg 7.7. Thereafter, the pH of the solution was lowered to cause flocculation and sedimentation for desalting. Further, 0.1 g of phenoxyethanol was added to the solution, which was adjusted to pH 5.9 and pAg 8.0, completing the formation of silver bromide grains. The thus obtained silver halide grains were cubic grains having a mean grain size of 0.07 μm, a coefficient of variation of the projected area diameter of 8%, and a (100) face proportion of 86%.

The thus obtained silver halide grains were heated at 60° C., to which 85 μmol of sodium thiosulfate, 11 μmol of 2,3,4,5,6-pentafluorophenyldiphenylphosphine selenide, 2 μmol of Tellurium Sensitizer B, 3.3 μmol of chloroauric acid, and 230 μmol of thiocyanic acid were added per mol of silver. The emulsion was ripened for 120 minutes. After the temperature was lowered to 40° C., with stirring, $3.5\times10^{-4}$ mol of Spectral Sensitizing Dye A and $4.6\times10^{-3}$ mol of 2-mercapto-5-methylbenzimidazole were added per mol of silver halide. The mixture was agitated for 10 minutes and quenched to 25° C., completing the preparation of Silver Halide Emulsion 2.

Organic Silver Salt Dispersion

While a mixture of 43.8 g of behenic acid (trade name Edenor C22-85R, by Henkel AG), 730 ml of distilled water, and 60 ml of tert-butanol was stirred at 79° C., 117 ml of 1N sodium hydroxide aqueous solution was added over 55 minutes, and reaction was continued for 240 minutes. Next, 112.5 ml of an aqueous solution containing 19.2 g of silver nitrate was added over 45 seconds to the solution, which was left to stand for 20 minutes and cooled to 30° C. Thereafter, the solids were separated by suction filtration and washed with water until the water filtrate reached a conductivity of 30 μS/cm. The thus obtained solids were handled as a wet cake without drying. To 100 g as dry solids of the wet cake, 4 g of polyvinyl alcohol PVA-205 (Kurare K.K.) and water were added to a total weight of 385 g. This was pre-dispersed in a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/m$^2$. There was obtained a silver behenate dispersion B. The silver behenate grains in this dispersion were acicular grains having a mean minor axis (or breadth) of 0.04 μm, a mean major axis (or length) of 0.8 μm, and a coefficient of variation of 30%. It is noted that particle dimensions were measured by Master Sizer X (Malvern Instruments Ltd.). The desired dispersion temperature was set by mounting serpentine heat exchangers at the front and rear sides of the interaction chamber and adjusting the temperature of refrigerant.

Dispersion of Reducing Agent

Water, 176 g, was added to 80 g of 1,1-bis(2-hydroxy-3,5-dimethylphenyl) -3,5,5-trimethylhexane and 64 g of a 20% aqueous solution of modified polyvinyl alcohol MP-203 (Kurare K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 5 hours for dispersion, obtaining a 25% solid particle dispersion of the reducing agent. The reducing agent particles in the dispersion had a mean diameter of 0.72 μm.

Dispersion of Mercapto Compound

Water, 224 g, was added to 64 g of 3-mercapto-4-phenyl-5-heptyl-1,2,4-triazole and 32 g of a 20% aqueous solution of modified polyvinyl alcohol MP-203 (Kurare K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 10 hours for dispersion, obtaining a 20% solid particle dispersion of the mercapto compound. The mercapto compound particles in the dispersion had a mean diameter of 0.67 μm.

Dispersion of Organic Polyhalide

Water, 224 g, was added to 48 g of tribromomethylphenylsulfone, 48 g of 3-tribromomethylsulfonyl-4-phenyl-5-tridecyl-1,2,4-triazole, and 48 g of a 20% aqueous solution of modified polyvinyl alcohol MP-203 (Kurare K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 5 hours for dispersion, obtaining a 30% solid particle dispersion of the polyhalide. The polyhalide particles in the dispersion had a mean diameter of 0.74 μm.

Methanol Solution of Phthalazine 10 g of 6-isopropylphthalazine was dissolved in 90 g of methanol.

Dispersion of Pigment

Water, 250 g, was added to 64 g of C. I. Pigment Blue 60 and 6.4 g of Demol N (Kao K.K.). They were thoroughly agitated to form a slurry. A vessel was charged with the slurry together with 800 g of zirconia beads having a mean diameter of 0.5 mm. A dispersing machine ¼G Sand Grinder Mill (Imex K.K.) was operated for 25 hours for dispersion, obtaining a 20% solid particle dispersion of the pigment. The pigment particles in the dispersion had a mean diameter of 0.21 μm.

SBR Latex

The SBR latex used was a latex of SBR polymer -St(68)-Bu(29)-AA(3)-having a mean particle size of 0.1 μm, an equilibrium moisture content (25° C., RH 60%) of 0.6 wt %, a concentration of 45%, an ionic conductivity of 4.2 mS/cm (as measured on a 40% latex stock liquid at 25° C. by a conductivity meter CM-30S by Toa Denpa Kogyo K.K.), and pH 8.2. A dilution of the SBR latex with distilled water by a factor of 10 was dilution purified through an ultrafiltration purifying module FS03-FC-FUY03A1 (Daisen Membrane System K.K.) until an ionic conductivity of 1.5 mS/cm was reached. The latex concentration was 40%.

Emulsion Layer Coating Solution

An emulsion layer coating solution was prepared by thoroughly mixing 103 g of the organic acid silver salt dispersion with 5 g of a 20 wt % aqueous solution of polyvinyl alcohol PVA-205 (Kurare K.K.), 23.2 g of the 25% reducing agent dispersion, 11.5 g of the 30% organic polyhalide dispersion, 3.1 g of the 20% mercapto compound dispersion, 106 g of the 40% ultrafiltrated SBR latex, 16 ml of the 10 wt % phthalazine compound solution, 0.8 g of the 20% pigment dispersion, 5 g of Silver Halide Emulsion 1, and 5 g of Silver Halide Emulsion 2. This coating solution was coated in an amount of 70 ml/m$^2$.

The emulsion layer coating solution had a viscosity of 85 mpa·s at 40° C. as measured by a B type viscometer (No. 1 rotor) by Tokyo Keiki K.K. When measured at 25° C. with a RFS fluid spectrometer by Rheometrics Far East K.K., the coating solution had a viscosity of 1500, 220, 70, 40, and 20 mpa·s at a shear rate of 0.1, 1, 10, 100, and 1000 s$^{-1}$, respectively.

Intermediate Layer Coating Solution

To 800 g of a 10 wt % aqueous solution of alkyl-modified polyvinyl alcohol PVA-203 (Kurare K.K.) were added 200 g of a UV-absorber in the form of a 30% latex of 2-hydroxy-4-(methacryloyloxyethoxy)benzophenone/methyl methacrylate copolymer (UVA-383MA by BASF) and 2 ml of a 5 wt % aqueous solution of Aerosol OT (American Cyanamid Co.). The resulting intermediate layer coating solution was coated on the emulsion layer in an amount of 5 ml/m$^2$.

This coating solution had a viscosity of 28 mpa·s at 40° C. as measured by the B type viscometer (No. 1 rotor).

Emulsion Side First Protective Layer Coating Solution

A first protective layer coating solution was prepared by dissolving 80 g of inert gelatin in water, adding thereto 64 ml of a 10% methanol solution of phthalic acid, 74 ml of a 10% aqueous solution of 4-methylphthalic acid, 28 ml of 1N sulfuric acid, and 5 ml of a 5 wt % aqueous solution of Aerosol OT (American Cyanamid Co.) and adding water so as to give a total weight of 1000 g. The coating solution was coated on the intermediate layer in an amount of 10 ml/m$^2$.

This coating solution had a viscosity of 17 mpa·s at 40° C. as measured by the B type viscometer (No. 1 rotor).

Emulsion Side Second Protective Layer Coating Solution

A second protective layer coating solution was prepared by dissolving 100 g of inert gelatin in water, adding thereto 20 ml of a 5% solution of potassium salt of N-perfluorooctylsulfonyl-N-propylalanine, 16 ml of a 5 wt % aqueous solution of Aerosol OT (American Cyanamid Co.), 25 g of polymethyl methacrylate microparticulates having a mean particle diameter of 4.0 $\mu$m, 1.4 g of phthalic acid, 1.6 g of 4-methylphthalic acid, 44 ml of 1N sulfuric acid, and 445 ml of a 4% aqueous solution of chromium alum, and adding water so as to give a total weight of 2000 g. This surface protective layer coating solution was coated on the first protective layer in an amount of 10 ml/m$^2$.

This coating solution had a viscosity of 9 mpa·s at 40° C. as measured by the B type viscometer (No. 1 rotor). Support PET support Using terephthalic acid and ethylene glycol, a polyethylene terephthalate (PET) having an intrinsic viscosity of 0.66 as measured in a phenol/tetrachloroethane 6/4 (weight ratio) mixture at 25° C. was prepared in a conventional manner. After the PET was pelletized and dried at 130° C. for 4 hours, it was melted at 300° C., extruded through a T-shaped die, and quenched to form an unstretched film having a thickness sufficient to give a thickness of 175 $\mu$m after thermosetting.

The film was longitudinally stretched by a factor of 3.3 by means of rollers rotating at different circumferential speeds and then transversely stretched by a factor of 4.5 by means of a tenter. The temperatures in these stretching steps were 110° C. and 130° C., respectively. Thereafter, the film was thermoset at 240° C. for 20 seconds and then transversely relaxed 4% at the same temperature. Thereafter, with the chuck of the tenter being slit and the opposite edges being knurled, the film was taken up under a tension of 4 kg/cm$^2$. In this way, a film of 175 $\mu$m thick was obtained in a roll form.

Using a solid state corona treating apparatus model 6KVA by Pillar Co., the support on both surfaces was treated with a corona discharge at room temperature while feeding the support at a speed of 20 m/min. It was determined from the readings of current and voltage that the support was treated at 0.375 kV·A·min/m$^2$. The operating frequency was 9.6 kHz and the gap clearance between the electrode and the dielectric roll was 1.6 mm.

Undercoat coating solution A

An undercoat coating solution A was prepared by adding 1 g of polystyrene microparticulates having a mean particle size of 0.2 $\mu$m and 20 ml of a 1 wt % solution of Surfactant A to 200 ml of a 30 wt % water dispersion of a polyester copolymer Pesresin A-515GB (Takamatsu Yushi K.K.). Distilled water was added to a total volume of 1,000 ml.

Surfactant A

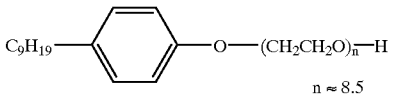

Undercoat coating solution B

An undercoat coating solution B was prepared by adding 200 ml of a 30 wt % water dispersion of a styrene-butadiene copolymer (styrene/butadiene/itaconic acid =47/50/3 in weight ratio) and 1.1 g of polystyrene microparticulates having a mean particle size of 0.4 $\mu$m to 680 ml of distilled water. Distilled water was added to a total volume of 1,000 ml.

Undercoat coating solution C

An undercoat coating solution C was prepared by dissolving 10 g of inert gelatin in 500 ml of distilled water and adding thereto 40 g of a 40 wt % water dispersion of tin oxide-antimony oxide composite microparticulates as described in JP-A 20033/1986. Distilled water was added to a total volume of 1,000 ml.

Subbed support

After one surface (photosensitive layer-bearing side) of the biaxially oriented PET support of 175 $\mu$m thick was subject to corona discharge treatment as described above, the undercoat coating solution A was applied to the support by means of a bar coater in a wet coverage of 5 ml/m$^2$, followed by drying at 180° C. for 5 minutes. The undercoat layer had a dry thickness of about 0.3 $\mu$m.

Next, the support was subject to corona discharge treatment on the back surface thereof. On the treated back surface, the undercoat coating solution B was applied by means of a bar coater in a wet coverage of 5 ml/m$^2$, followed by drying at 180° C. for 5 minutes to form a back undercoat having a dry thickness of about 0.3 $\mu$m. Further, the undercoat coating solution C was applied onto the back undercoat by means of a bar coater in a wet coverage of 3 ml/m$^2$, followed by drying at 180° C. for 5 minutes to form a second back undercoat having a dry thickness of about 0.03 $\mu$m. The subbed support was completed in this way.

Solid Particle Dispersion of Base Precursor (a)

Distilled water, 246 ml, was mixed with 64 g of Base Precursor (7) (mp. 90° C.) and 10 g of a surfactant Demol N (Kao K.K.). The mixture was dispersed with beads in a sand mill (¼ gallon Sand Grinder Mill by Imex K.K.). The resulting solid particle dispersion (a) of the base precursor had a mean particle diameter of 0.2 $\mu$m.

Base Precursor (7)

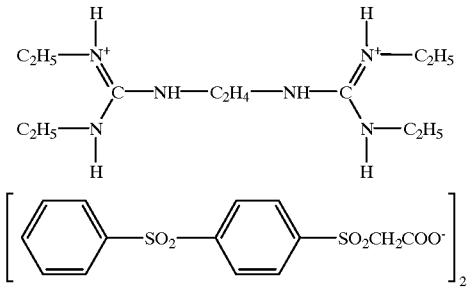

Solid Particle Dispersions of Base Precursor (b), (c)

Distilled water, 220 ml, was mixed with 64 g of Base Precursor (7), 14 g of Diphenylsulfone (8) (mp. 127° C.), and 10 g of a surfactant Demol N (Kao K.K.). The mixture was dispersed with beads in a sand mill (¼ gallon Sand Grinder Mill by Imex K.K.). The resulting solid particle co-dispersion (b) of the base precursor and diphenylsulfone had a mean particle diameter of 0.2 μm.

A similar co-dispersion (c) was prepared using 28 g of Diphenylsulfone (8).

Diphenylsulfone (8)

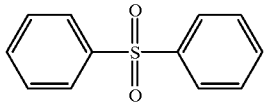

Solid Particle Dispersions of Base Precursor (d), (e)

Distilled water, 220 ml, was mixed with 64 g of Base Precursor (7), 16 g of 4-chlorophenyl(phenyl) sulfone (9) (mp. 90° C.), and 10 g of a surfactant Demol N (Kao K.K.). The mixture was dispersed with beads in a sand mill (¼ gallon Sand Grinder Mill by Imex K.K.). The resulting solid particle co-dispersion (d) of the base precursor and 4-chlorophenyl(phenyl)sulfone had a mean particle diameter of 0.2 μm.

A similar co-dispersion (e) was prepared using 32 g of 4-chlorophenyl(phenyl) sulfone (9).

4-chlorophenyl (phenyl) sulfone (9)

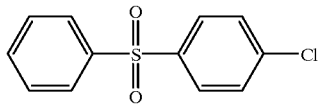

Solid Particle Dispersion of Dye

Distilled water, 305 ml, was mixed with 9.6 g of Cyanine Dye (10) and 5.8 g of sodium p-alkylbenzenesulfonate. The mixture was dispersed with beads in a sand mill (¼ gallon Sand Grinder Mill by Imex K.K.). The resulting solid particle dispersion of the dye had a mean particle diameter of 0.2 μm.

Cyanine Dye (10)

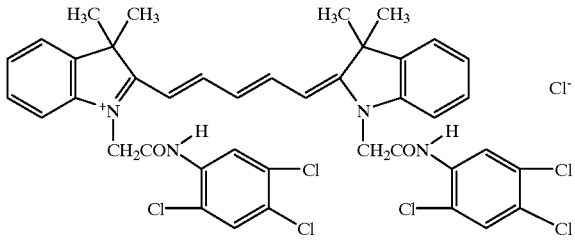

Antihalation Layer Coating Solution

An antihalation layer coating solution was prepared by mixing the following components.

| | | |
|---|---|---|
| 1. | gelatin | 17 g |
| 2. | polyacrylamide | 9.6 g |
| 3. | solid particle dispersion of base precursor | 70 g |
| 4. | solid particle dispersion of dye | 56 g |
| 5. | polymethyl methacrylate microparticulates (mean particle size 6.5 μm) | 1.5 g |
| 6. | sodium polyethylenesulfonate | 2.2 g |
| 7. | Blue Dyestuff (11) | 0.2 g |

-continued

| | | |
|---|---|---|
| 8. | $H_2O$ | 844 ml |

Blue Dyestuff (11)

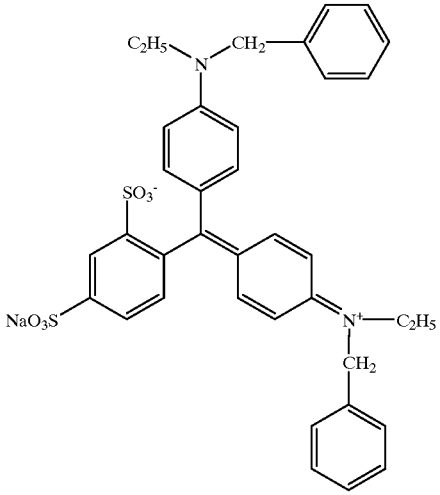

Back Surface Protective Layer Coating Solution

A back surface protective layer coating solution was prepared by mixing the following components in a vessel at 40° C.

| | |
|---|---|
| 1. gelatin | 50 g |
| 2. sodium polystyrenesulfonate | 0.2 g |
| 3. N,N'-ethylenebis (vinylsulfonacetamide) | 2.4 g |
| 4. sodium t-octylphenoxyethoxyethanesulfonate | 1 g |
| 5. $C_8F_{17}SO_3K$ | 32 mg |
| 6. $C_8F_{17}SO_2N(C_3H_7)(CH_2CH_2O)_4(CH_2)_4—SO_3Na$ | 64 mg |
| 7. Compound (12) | 30 mg |
| 8. $H_2O$ | 950 ml |

Compound (12)

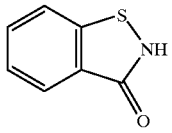

Antihalation Back Layer

On the back side of the subbed PET film or support of 175 μm thick, the antihalation layer coating solution and the back surface protective layer coating solution were simultaneously applied in a multiple or overlapping manner so that the amount of solid microparticulate dye coated (from the former solution) was 0.04 g/m$^2$ and the amount of gelatin coated (from the latter solution) was 1 g/m$^2$. On drying, an antihalation back layer was formed.

Onto the side of the support opposite to the back side, the emulsion layer, intermediate layer, first protective layer, and second protective layer were simultaneously applied in a multiple or overlapping manner in this order from the subbed surface by the slide bead coating method. A photothermographic element sample was prepared in this way.

Coating was effected at a speed of 160 m/min. The spacing between the tip of the coating die and the support was set to 0.18 mm. The pressure in a vacuum chamber was lower than the atmospheric pressure by 392 Pa. In the subsequent chilling zone, air having a dry bulb temperature of 18° C. and a wet bulb temperature of 12° C. was blown at an average wind velocity of 7 m/sec for 30 seconds for cooling the coating solution. In a drying zone, drying air having a dry bulb temperature of 30° C. and a wet bulb temperature of 18° C. was blown at an average wind velocity of 7 m/sec for 200 seconds for volatilizing off the solvent from the coating solution.

Melting Point

The dispersions (a) to (e) were evaporated to dryness at low temperature. These samples were measured for melting point (° C.) using a differential scanning calorimeter Type TA7000 by ULVAC. The difference from the melting point (° C.) of the base precursor alone was determined. The results are shown under the heading "MP drop" in Table 1.

Thermal Bleach

The photothermographic element samples prepared above were heat developed at 120° C. for 20 seconds by means of a heat developing system of the plate heater type as shown in FIG. 1 of Japanese Patent Application No. 229684/1997. After the layers on the emulsion side were removed, the back layer was examined for residual color by measuring an absorbance at 660 nm. The percent thermal bleach is calculated by dividing the absorbance of the heat-developed sample by the absorbance of the same sample before heat development. The results are shown in Table 1. A percent thermal bleach of 5% or less is satisfactory.

Water Resistance

The photothermographic element samples prepared above were similarly heat developed at 120° C. for 20 seconds by means of a heat developing system of the plate heater type in a dark room, obtaining unexposed, developed samples. A water droplet was applied onto the back surface of each sample, which was allowed to stand for 30 seconds, lightly wiped and dried in air. The sample was visually observed under white light transmitted by an opal plate. The sample was evaluated in three ratings, "Good" when no water droplet mark was seen, "Fair" when a slight, but inoffensive droplet mark was seen, and "Poor" when a distinct water droplet mark was seen to disturb the image. The results are shown in Table 1.

TABLE 1

| Sample No. | Dispersion | MP drop (deg) | Thermal bleach | Water resistance |
|---|---|---|---|---|
| 1* | (a) | 0 | 38% | Poor |
| 2 | (b) | −8 | 2% | Good |
| 3 | (c) | −13 | 0% | Good |
| 4 | (d) | −10 | 2% | Good |
| 5 | (e) | −16 | 0% | Good |

*outside the scope of the invention

As is evident from Table 1, the samples within the scope of the invention are improved in thermal bleach and water resistance.

It is noted that satisfactory photographic properties were obtained when sample Nos. 2 to 5 were exposed by means of a 635-nm laser diode sensitometer and processed at 120° C. for 20 seconds for heat development.

Example 2

Photothermographic element samples were prepared as in Example 1 except that Spectral Sensitizing dye A was replaced by an equimolar amount of Spectral Sensitizing Dye B and the solid particle dispersion of the base precursor and the solid particle dispersion of the dye were changed as follows.

Spectral Sensitizing Dye B

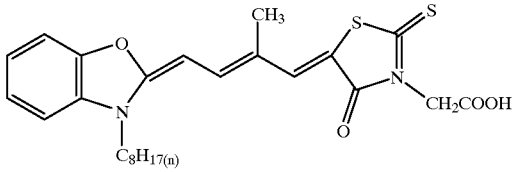

Solid Particle Dispersions of Base Precursor (f), (a)

Distilled water, 220 ml, was mixed with 64 g of Base Precursor (7), 10 g of Diphenylsulfone (8), 10 g of 4-chlorophenyl(phenyl) sulfone (9), and 10 g of a surfactant Demol N (Kao K.K.). The mixture was dispersed with beads in a sand mill (¼ gallon Sand Grinder Mill by Imex K.K.). The resulting solid particle co-dispersion (f) of the base precursor and diphenylsulfones had a mean particle diameter of 0.2 μm.

A similar co-dispersion (g) was prepared using 14 g of Diphenylsulfone (8) and 14 g of Compound (13) (mp. 147° C.).

Compound (13)

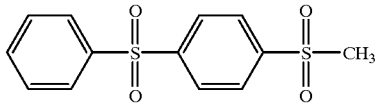

Solid Particle Dispersions of Base Precursor (h), (i)

Distilled water, 220 ml, was mixed with 64 g of Base Precursor (7), 12 g of 4-chlorophenyl(phenyl) sulfone (9), 12 g of Compound (13), and 10 g of a surfactant Demol N (Kao K.K.). The mixture was dispersed with beads in a sand mill (¼ gallon Sand Grinder Mill by Imex K.K.). The resulting solid particle co-dispersion (h) of the base precursor and diphenylsulfones had a mean particle diameter of 0.2 μm.

A similar co-dispersion (i) was prepared using 18 g of 4-chlorophenyl(phenyl)sulfone (9) and 18 g of Compound (13).

Solid Particle Dispersion of Base Precursor (1)

Distilled water, 220 ml, was mixed with 64 g of Base Precursor (7), 6.4 g of Compound (14) (mp. 129° C.), 6.4 g of Compound (15) (mp. 113° C.), and 10 g of a surfactant Demol N (Kao K.K.). The mixture was dispersed with beads in a sand mill (¼ gallon Sand Grinder Mill by Imex K.K.). The resulting solid particle co-dispersion (j) of the base precursor and Compounds (13) and (15) had a mean particle diameter of 0.2 μm.

Compound (14)

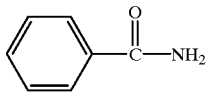

Compound (15)

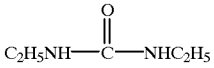

Solid Particle Dispersion of Dye

Distilled water, 305 ml, was mixed with 9.6 g of Cyanine Dye (16) and 5.8 g of sodium p-alkylbenzenesulfonate. The mixture was dispersed with beads in a sand mill (¼ gallon Sand Grinder Mill by Imex K.K.). The resulting solid particle dispersion of the dye had a mean particle diameter of 0.2 $\mu$m.

Cyanine Dye (16)

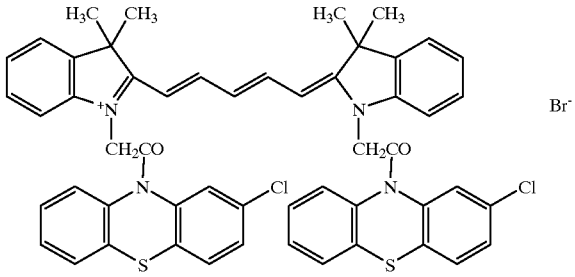

The samples were tested as in Example 1, with the results shown in Table 2.

TABLE 2

| Sample No. | Dispersion | MP drop (deg) | Thermal bleach | Water resistance |
|---|---|---|---|---|
| 1* | (a) | 0 | 38% | Poor |
| 6 | (f) | −9 | 1% | Good |
| 7 | (g) | −18 | 0% | Good |
| 8 | (h) | −11 | 1% | Good |
| 9 | (i) | −15 | Q% | Good |
| 10 | (j) | −3 | 4% | Good |

*outside the Scope of the invention

As is evident from Table 2, the samples within the scope of the invention are improved in thermal bleach and water resistance.

It is noted that satisfactory photographic properties were obtained when sample Nos. 6 to 10 were exposed by means of a 635-nm laser diode sensitometer and processed at 120° C. for 20 seconds for heat development.

After sample Nos. 6 to 10 were exposed by means of a 663-nm laser diode (double 35-mW lasers) sensitometer and similarly heat developed, the resulting images were duplicated on radiographic duplicating films FUJI MI-Dup by Fuji Photo Film Co., Ltd. Satisfactory duplicates were obtained.

Example 3

Sample No. 11 was prepared by the same procedure as sample No. 3 in Example 1 except that Cyanine Dye (10) was replaced by an equimolar amount of Cyanine Dye (17). It was similarly tested, finding thermal bleach 0% and water resistance "Good."

Sample Nos. 3 and 11 were kept in dark for 5 days at 50° C. and RH 75%. Aged sample No. 3 showed no drop of the optical density of the cyanine dye whereas aged sample No. 11 showed a drop of the optical density.

Cyanine Dye (17)

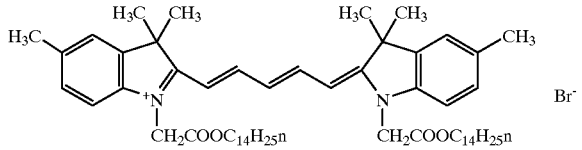

The photothermographic element using a melting point depressant according to the invention produces a satisfactory image with minimal residual color and improved water resistance.

Japanese Patent Application No. 95082/1998 is incorporated herein by reference.

Reasonable modifications and variations are possible from the foregoing disclosure without departing from either the spirit or scope of the present invention as defined by the claims.

What is claimed is:

1. A photothermographic element comprising a support having a front surface and a back surface, at least one photosensitive layer on the front surface side of the support, and a first non-photosensitive layer on the front surface side or the back surface side of the support, said first non-photosensitive layer containing (1) a base-bleachable cyanine dye or a salt thereof and (2) a binder, wherein said first non-photosensitive layer or a second non-photosensitive layer disposed adjacent thereto contains (3) a base precursor and (4) a melting point depressant which, when mixed with the base precursor, acts to depress the melting point of the base precursor by at least 3° C., and wherein said at least one photosensitive layer comprises a photosensitive silver halide and a binder, and further comprises at least one component selected from the group consisting of a reducing agent and an organic silver salt.

2. The photothermographic element of claim 1, wherein a co-dispersion of (3) said base precursor and (4) said melting point depressant is contained in the first or second non-photosensitive layer.

3. The photothermographic element of claim 1, wherein a co-dispersion of (3) said base precursor and (4) a mixture of melting point depressants which, when mixed with the base precursor, cooperate to depress the melting point of the base precursor by at least 3° C. is contained in the first or second non-photosensitive layer.

4. The photothermographic element of claim 1, wherein said first non-photosensitive layer is disposed on the back surface side of the support.

5. The phototherographic element of claim 1, wherein said base-bleachable cyanine dye or salt thereof (1) is a cyanine dye or salt thereof having the following formula (II):

(II)

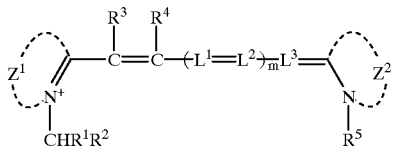

wherein $R^1$ represents an electron attractive group, $R^2$ represents hydrogen or an aliphatic or aromatic group, $R^3$ and $R^4$ independently represent hydrogen, a halogen atom, an aliphatic group, an aromatic group, —$NR^6R^7$, —$OR^6$, or —$SR^7$, $R^6$ and $R^7$ independently represent hydrogen or an aliphatic or aromatic group, $R^5$ represents an aliphatic group, each of $L^1$, $L^2$, and $L^3$ independently represents a substituted or unsubstituted methine group in which substituents on the methine group may bond together to form an unsaturated aliphatic ring or an unsaturated heterocyclic ring, each of $Z^1$ and $Z^2$ independently represents a group of atoms that form an unsubstituted or substituted 5- or 6-membered nitrogenous heterocyclic ring which may have an unsubstituted or substituted aromatic ring fused thereto, and m represents 0, 1, 2 or 3.

6. The photothermographic element of claim 5, wherein in $Z^1$ and $Z^2$, said 5- or 6-membered nitrogenous heterocyclic ring and said aromatic ring are optionally substituted by one or more of the groups selected from the group consisting of carboxyl groups and salts thereof, sulfo groups and salts thereof, sulfonamide groups of 1 to 20 carbon atoms, sulfamoyl groups of 0 to 20 carbon atoms, sulfonylcarbamoyl groups of 2 to 20 carbon atoms, acylsulfamoyl groups of 1 to 20 carbon atoms, chain or cyclic alkyl groups of 1 to 20 carbon atoms, alkenyl groups of 2 to 20 carbon atoms, alkoxy groups of 1 to 20 carbon atoms, halogen atoms, amino groups of 0 to 20 carbon atoms, alkoxycarbonyl groups of 2 to 20 carbon atoms, amide groups of 1 to 20 carbon atoms, carbamoyl groups of 1 to 20 carbon atoms, aryl groups of 6 to 20 carbon atoms, aryloxy groups of 6 to 20 carbon atoms, alkylthio groups of 1 to 20 carbon atoms, arylthio groups of 6 to 20 carbon atoms, acyl groups of 1 to 20 carbon atoms, sulfonyl groups of 1 to 20 carbon atoms, ureido groups of 1 to 20 carbon atoms, alkoxycarbonylamino groups of 2 to 20 carbon atoms, cyano groups, hydroxyl groups, nitro groups, and heterocyclic groups.

7. The photothermographic element of claim 1, wherein said base precursor is a diacidic base precursor.

8. A photothermographic element according to claim 1, wherein said melting point depressant is a compound of the following formula (I):

(I)

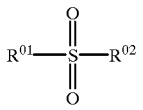

wherein $R^{01}$ and $R^{02}$ independently represent an aliphatic, aromatic or heterocyclic group which is free of a carboxyl group and carboxyl group salt.

9. The photothermographic element of claim 8, wherein said non-photosensitive layer is disposed on the back surface side of the support.

10. The photothermographic element of claim 7 wherein said base precursor is a diacidic base precursor.

11. The photothermographic element according to claim 1, wherein a solid particle co-dispersion of (3) said base precursor and (4) said melting point depressant is contained in the first or second non-photosensitive layer and the dispersed particles have a mean particle size of 0.03 to 0.3 μm.

12. The photothermographic element according to claim 1, wherein the amount of the melting point depressant used is 1 to 500% by weight of the base precursor.

13. The photothermographic element according to claim 1, wherein the amount of the melting point depressant used is 5 to 200% by weight of the base precursor.

14. The photothermographic element according to claim 1, wherein said first non-photosensitive layer or a second non-photosensitive layer disposed adjacent thereto contains (3) a base precursor and (4) a melting point depressant which, when mixed with the base precursor, acts to depress the melting point of the base precursor by about 3 to 20° C.

15. The photothermographic element according to claim 1, wherein said first non-photosensitive layer or a second non-photosensitive layer disposed adjacent thereto contains (3) a base precursor and (4) a melting point depressant which, when mixed with the base precursor, acts to depress the melting point of the base precursor by about 5 to 15° C.

16. A photothermographic element comprising a support having a first surface and a second surface, at least one photosensitive layer on the first surface of the support, and a first non-photosensitive layer on the first or second surface of the support, said first non-photosensitive layer containing (1) a base-bleachable dye or a salt thereof and (2) a binder, wherein said first non-photosensitive layer or a second non-photosensitive layer disposed adjacent thereto contains (3) a base precursor and (4) a melting point depressant which, when mixed with the base precursor, acts to depress the melting point of the base precursor by at least 30° C.; and wherein said base-bleachable dye or salt thereof is a cyanine dye or salt thereof having the following formula (II):

(II)

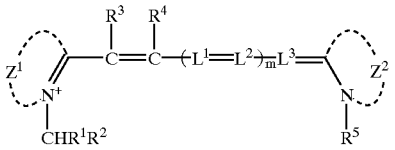

wherein $R^1$ represents an electron attractive group, $R^2$ represents hydrogen or an aliphatic or aromatic group, $R^3$ and $R^4$ independently represent hydrogen, a halogen atom, an aliphatic group, an aromatic group, —$NR^6R^7$, —$OR^6$, or —$SR^7$, $R^6$ and $R^7$ independently represent hydrogen or an aliphatic or aromatic group, $R^5$ represents an aliphatic group, each of $L^1$, $L^2$, and $L^3$ independently represents a substituted or unsubstituted methine group in which substituents on the methine group may bond together to form an unsaturated aliphatic ring or an unsaturated heterocyclic ring, each of $Z^1$ and $Z^2$ independently represents a group of atoms that form an unsubstituted or substituted 5- or 6-membered nitrogenous heterocyclic ring which may have an unsubstituted or substituted aromatic ring fused thereto, m represents 0, 1, 2 or 3, and wherein said at least one photosensitive layer comprises a photosensitive silver halide and a binder, and further comprises at least one component selected from the group consisting of a reducing agent and an organic silver salt.

* * * * *

UNITED STATES PATENT AND TRADEMARK OFFICE

CERTIFICATE OF CORRECTION

PATENT NO. : 6,300,053 B1
DATED : October 9, 2001
INVENTOR(S) : Itsuo Fujiwara et al.

It is certified that error appears in the above-identified patent and that said Letters Patent is hereby corrected as shown below:

Column 53,
Line 58, please change “claim 7” to -- claim 8 --.

Column 54,
Line 27, please change “30º C.” to -- 3º C. --.

Signed and Sealed this

Thirteenth Day of August, 2002

*Attest:*

*Attesting Officer*

JAMES E. ROGAN
*Director of the United States Patent and Trademark Office*